US005401388A

United States Patent [19]

Schmidt et al.

[11] Patent Number: 5,401,388

[45] Date of Patent: Mar. 28, 1995

[54] SELECTIVE UPGRADING OF NAPHTHA

[75] Inventors: Robert J. Schmidt, Rolling Meadows; Michael B. Russ, Villa Park; Paula L. Bogdan, Mount Prospect; R. Joe Lawson, Arlington Heights, all of Ill.; Norman L. Gilsdorf, Guildford, England

[73] Assignee: UOP, Des Plaines, Ill.

[21] Appl. No.: 117,466

[22] Filed: Sep. 7, 1993

Related U.S. Application Data

[63] Continuation-in-part of Ser. No. 795,573, Nov. 21, 1991, Pat. No. 5,242,576.

[51] Int. Cl.[6] ..... C10G 59/06; C10G 63/06

[52] U.S. Cl. ..... 208/79; 208/78; 208/80; 208/63; 208/64; 208/65

[58] Field of Search ..... 208/63, 64, 65, 78, 208/79, 80

[56] References Cited

U.S. PATENT DOCUMENTS

| | | | |
|---|---|---|---|
| 3,172,841 | 3/1965 | Paterson | 208/79 |
| 3,679,575 | 7/1972 | Bertolachini | 208/65 |
| 3,753,891 | 8/1973 | Graven et al. | 208/65 |
| 3,759,819 | 9/1973 | Attane et al. | 208/57 |
| 3,770,614 | 11/1973 | Graven | 208/62 |
| 3,788,975 | 1/1974 | Donaldson | 208/60 |
| 3,933,619 | 1/1976 | Kozlowski | 208/60 |
| 4,594,145 | 6/1986 | Roarty | 208/79 |
| 4,647,368 | 3/1987 | McGuiness et al. | 208/60 |
| 4,808,295 | 2/1989 | Nemet-Mavrodin | 585/65 |
| 4,897,177 | 1/1990 | Nadler | 208/79 |

*Primary Examiner*—Helen M. S. Sneed
*Assistant Examiner*—Walter D. Griffin
*Attorney, Agent, or Firm*—Thomas K. McBride; John F. Spears, Jr.; Richard E. Conser

[57] ABSTRACT

A process combination is disclosed to selectively upgrade naphtha to obtain gasoline which is in accordance with current standards for reformulated fuels. A naphtha feedstock is fractionated to selectively direct light naphtha to isomerization or blending, a head-cut fraction to reforming, and a heavy potion to selective isoparaffin synthesis to yield light and heavy synthesis naphtha and isobutane. The heavy potion of the synthesis naphtha is processed by reforming. Light naphtha may be isomerized, with or without recycle of low-octane components of the product. A gasoline component is blended from light, synthesis, and reformate products from the process combination.

23 Claims, 4 Drawing Sheets

SELECTIVE UPGRADING OF NAPHTHA

Cross-Reference to Related Applications

This application is a continuation-in-part of application Ser. No. 795,573, filed Nov. 21, 1991, now U.S. Pat. No. 5,242,576 incorporated herein by reference.

BACKGROUND OF THE INVENTION

1. Field Of the Invention

This invention relates to an improved process combination for the conversion of hydrocarbons, and more specifically for the selective upgrading of naphtha fractions by a combination of reforming and selective isoparaffin synthesis.

2. General Background

The widespread removal of lead antiknock additive from gasoline and the rising fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, isomerization of light naphtha and the use of oxygenated compounds. Such key options as increased reforming severity and higher FCC gasoline octane result in a higher aromatics content of the gasoline pool, through the production of high-octane aromatics at the expense of low-octane heavy paraffins. Current gasolines generally have aromatics contents of about 30% or higher, and may contain more than 40% aromatics.

Currently, refiners are faced with the prospect of supplying reformulated gasoline to meet tightened automotive emission standards. Reformulated gasoline would differ from the existing product in having a lower vapor pressure, lower final boiling point, increased content of oxygenates, and lower content of olefins, benzene and aromatics. The oxygen content of gasoline will be 2% or more in many areas. Gasoline aromatics content is likely to be lowered into the 20–25% range in major urban areas, and low-emission gasoline containing less than 15% aromatics is being advocated for some areas with severe pollution problems. Distillation end points also could be lowered, further restricting aromatics content since the high-boiling portion of the gasoline which thereby would be eliminated usually is an aromatics concentrate. End point often is characterized as the 90% distillation temperature, currently limited to a maximum of 190° C. and averaging 165°–170° C., which could be reduced to around 150° C. in some cases.

Since aromatics have been the principal source of increased gasoline octanes during the recent lead-reduction program, severe restriction of the aromatics content and high-boiling portion will present refiners with processing problems. Currently applicable technology includes such processes as recycle isomerization of light naphtha, increased yields of light olefins from fluid catalytic cracking and isobutane production by isomerization as feedstock to an alkylation unit. Increased blending of oxygenates such as methyl tertiary-butyl ether (MTBE) and ethanol will be an essential part of the reformulated-gasoline program, but feedstock supplies will become stretched. Novel processing technology is needed to support an effective program.

Related Art

Process combinations for the upgrading of naphtha to yield gasoline are known in the art. These combine known and novel processing steps primarily to increase gasoline octane, generally by producing and/or recovering aromatics needed to compensate for lead-antiknock removal from gasoline over a period of about 15 years.

U.S. Pat. No. 3,172,841 discloses separation of naphtha from 375° F.+ gas oil, hydrocracking of the gas oil, and reforming of the naphtha and gas oil. Separate reforming of light and heavy naphtha, followed by conversion of paraffins in light reformate using a zeolite catalyst, is taught in U.S. Pat. No. 3,770,614 (Graven). U.S. Pat. No. 4,594,145 (Roarty) discloses separation of naphtha into $C_6/C_7$ feed to aromatization and $C_7$ feed to catalytic reforming. Aromatics production by conversion over an acidic zeolite followed by conversion using a catalyst comprising platinum and low-acidity zeolite is taught in U.S. Pat. No. 4,808,295 (Nemet-Mavrodin). Although the above schemes teach various combinations which may include fractionation, converting and/or reforming, none of them disclose the present process combination of reforming and selective isoparaffin synthesis for selective upgrading of naphtha.

U.S. Pat. No. 3,788,975 (Donaldson) teaches a combination process for the production of aromatics and isobutane using "I-cracking" followed by a combination of processes including catalytic reforming, aromatic separation, alkylation, isomerization, and dehydrogenation to yield alkylation feedstock. The paraffinic stream from aromatic extraction is returned to the cracking step. Donaldson does not disclose the present process combination, however, and would not realize the present gasoline selectivity from the selective-isoparaffin-synthesis/reforming combination.

A combination process including hydrocracking for gasoline production is disclosed in U.S. Pat. No. 3,933,619 (Kozlowski). High-octane, low-lead or unleaded gasoline is produced by hydrocracking a hydrocarbon feedstock to obtain butane, pentane, hexane, and $C_7$+ hydrocarbons, and the $C_7$+ fraction may be sent to a reformer. U.S. Pat. No. 4,647,368 (McGuiness et al.) discloses a method for upgrading naphtha by hydrocracking over zeolite beta, recovering isobutane, $C_5$–$C_7$ isoparaffins and a higher boiling stream, and reforming the latter stream. These references do not teach or suggest the present process combination, however.

The prior art does contain elements of the present invention. There is no suggestion to combine the elements, however, nor of the surprising benefits in selectivity that accrue from the present process combination to produce a gasoline component suitable for reformulated gasoline.

SUMMARY OF THE INVENTION

It is an object of the present invention to provide an improved process combination to upgrade naphtha to gasoline. A specific object is to produce high-octane gasoline having a reduced distillation end point, especially with minimum sacrifice in the yield of gasoline from naphtha.

This invention is based on the discovery that a process combination based on processing of selected naphtha fractions by selective isoparaffin synthesis and catalytic reforming can yield a gasoline component having a reduced distillation end point with benefits in gasoline yield relative to prior-art processes. The net hydrogen balance also is more favorable, and the major byproduct is isobutane which can be processed to yield additional gasoline.

A broad embodiment of the present invention is directed to a process combination comprising separation of a naphtha feedstock into selected naphtha fractions, selective isoparaffin synthesis from heavy naphtha to yield a product comprising isobutane and synthesis naphtha with reduced end point, reforming a heart-cut naphtha containing $C_7$ and $C_8$ hydrocarbons and blending the resulting products to obtain a gasoline component. In a preferred embodiment, heavy synthesis product is separated from the synthesis naphtha and reformed in combination with the heart-cut naphtha to upgrade the octane number of the gasoline component.

Light naphtha from separation of the naphtha feedstock is isomerized, in a alternative embodiment, and blended into the gasoline component.

These as well as other objects and embodiments will become apparent from the detailed description of the invention.

DESCRIPTION OF THE PREFERRED EMBODIMENTS

Figure 1:
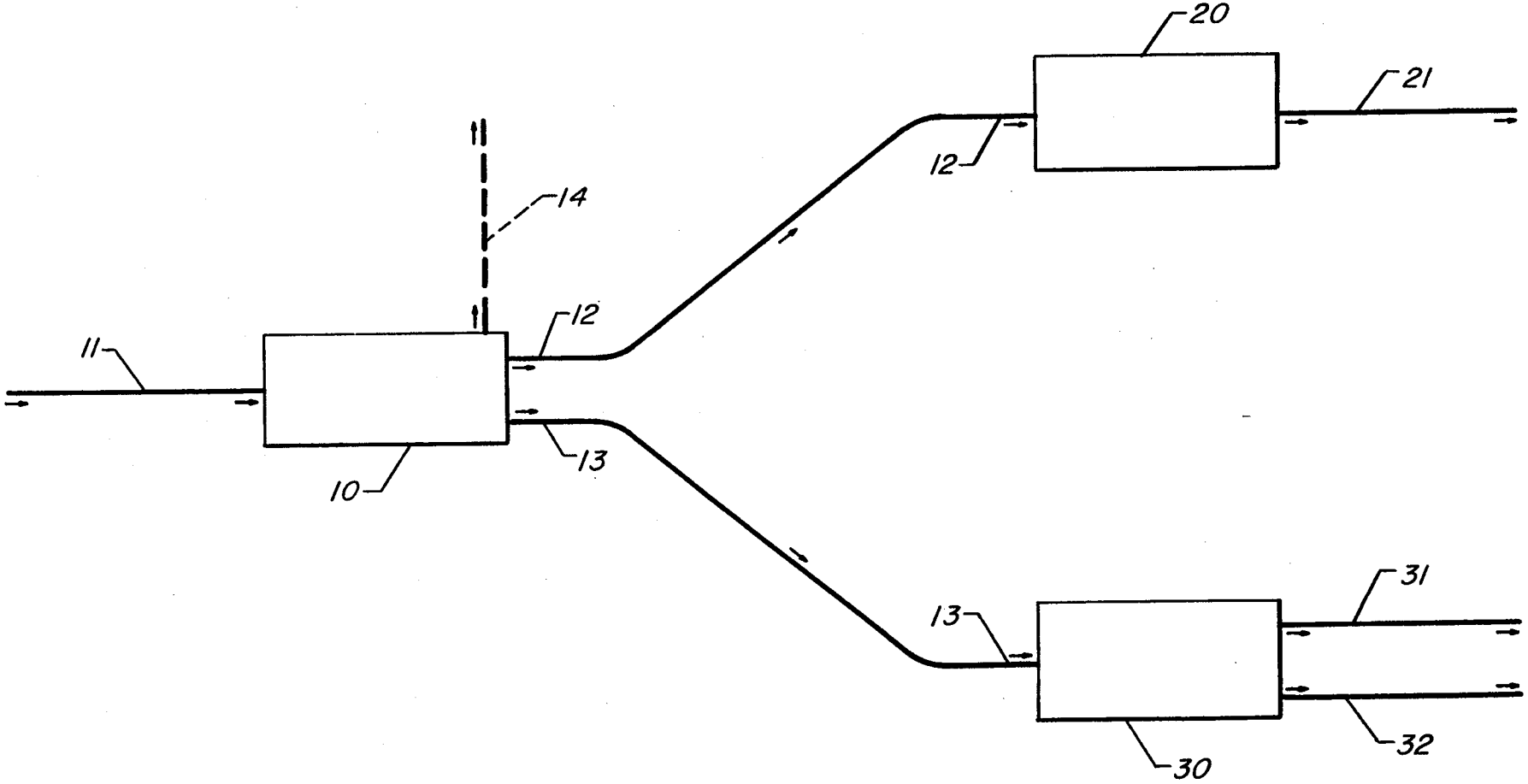
FIG. 1 represents a simplified block flow diagram showing the arrangement of the major sections of the present invention.

To reiterate, a broad embodiment of the present invention is directed to a process combination comprising separation of a naphtha feedstock into selected naphtha fractions, selective isoparaffin synthesis from heavy naphtha to yield a product comprising isobutane and synthesis naphtha with reduced end point, reforming a heart-cut naphtha containing $C_7$ and $C_8$ hydrocarbons and blending the resulting products to obtain a gasoline component. Usually the process combination is integrated into a petroleum refinery comprising crude-oil distillation, reforming, cracking and other processes known in the art to produce finished gasoline and other petroleum products.

The naphtha feedstock to the present process combination will comprise paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range generally is that of a full-range naphtha, having an initial boiling point typically from 0° to 100° C. and a final boiling point of from about 160° to 230° C.; more usually, the initial boiling range is from about 40° to 80° C. and the final boiling point from about 175° to 200° C. In any event, the naphtha feedstock contains a substantial concentration of $C_7$–$C_{10}$ hydrocarbons; if the feedstock were to be processed directly in a conventional catalytic reforming unit, the product reformate would contain excessive high-boiling compounds for blending into current well-publicized "reformulated gasolines" which have been specified to reduce automotive emissions.

The presence of high-boiling compounds is characterized by the end point, or final boiling point, and/or 90% distillation point as measured by the standard ASTM D-86 distillation test. End points of reformates are significantly higher than those of the reformer feeds from which they are derived. The present process combination enables processing of a naphtha feedstock containing higher-boiling compounds than otherwise would be possible, according to processes of the prior art, with high gasoline yields while meeting reformulated-gasoline specifications. The high-boiling portion of the naphtha feedstock is converted in the selective-isoparaffin-synthesis step to obtain a lower-boiling selective-isoparaffin-synthesis product which can be blended into gasoline or processed in the reforming zone, thereby converting a greater proportion of naphtha into gasoline than if a narrower-range feedstock were processed by catalytic reforming without selective isoparaffin synthesis.

The naphtha feedstock generally contains small amounts of sulfur compounds amounting to less than 10 parts per million (ppm) on an elemental basis. Preferably the naphtha feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from hydrocarbons by fractionation. This conversion preferably will employ a catalyst known to the art comprising an inorganic oxide support and metals selected from Groups VIB(6) and VIII(9-10) of the Periodic Table. [See Cotton and Wilkinson, *Advanced Inorganic Chemistry,* John Wiley & Sons (Fifth Edition, 1988)]. Preferably, the pretreating step will provide the selective-isoparaffin-synthesis step with a hydrocarbon feedstock having low sulfur levels disclosed in the prior art as desirable, e.g., 1 ppm to 0.1 ppm (100 ppb). It is within the ambit of the present invention that this optional pretreating step be included in the present process combination.

The broad and preferred embodiments of the present invention are optimally understood by reference to the Figure. The process combination comprises a separation zone 10, a reforming zone 20, and an selective-isoparaffin-synthesis zone 30. Optional units for light-naphtha isomerization and for dehydrogenation, etherification or alkylation of synthesis-product isobutane concentrate are not shown in the Figure, but are discussed hereinafter. For clarity, only the major sections and interconnections of the process combination are shown. Individual equipment items such as reactors, heaters, heat exchangers, separators, fractionators, pumps, compressors and instruments are well known to the skilled routineer; description of this equipment is not necessary for an understanding of the invention or its underlying concepts. Operating conditions, catalysts, design features and feed and product relationships are discussed hereinbelow.

The naphtha feedstock is introduced into separation zone 10 via line 11. The separation zone generally comprises one or more fractional distillation columns having associated appurtenances and separates a heart-cut naphtha fraction withdrawn via line 12 from a heavy naphtha fraction withdrawn via line 13. The lower-boiling heart-cut naphtha contains a substantial concentration of $C_7$ and $C_8$ hydrocarbons, which can be catalytically reformed to produce a reformate component suitable for blending into current reformulated gasolines. This heart-cut naphtha also may contain significant concentrations of C6 and C9 hydrocarbons, plus smaller amounts of lower- and higher-boiling hydrocarbons, depending on the applicable gasoline specifications and product needs. The heart-cut naphtha end point may range from about 130° to 175° C., and preferably is within the range of about 145° to 165° C. The higher-boiling heavy naphtha contains a substantial amount of $C_{10}$ hydrocarbons, and also may contain significant quantities of lighter and heavier hydrocarbons depending primarily on a petroleum refiner's overall product balance. The initial boiling point of the heavy naphtha is between about 120° and 175° C., and preferably is between 140° and 165° C.

Optionally, a light naphtha fraction may be separated from the naphtha feedstock in the separation zone via line 14. The light naphtha comprises pentanes, and may comprise $C_6$ hydrocarbons. This fraction is separated from the heart-cut naphtha because pentanes are not converted efficiently in a reforming zone, and optionally because $C_6$ hydrocarbons may be an undesirable feed to catalytic reforming where they are converted to benzene for which gasoline restrictions are being implemented. The light naphtha fraction may be separated from the naphtha feedstock before it enters the separation zone, in which case this zone would only separate heart-cut naphtha from heavy naphtha. If the pentane content of the naphtha feedstock is substantial, however, separation of light naphtha generally is desirable. This alternative separation zone generally comprises two fractionation columns, although in some cases a single column recovering light naphtha overhead, heavy naphtha from the bottom and heart-cut naphtha as a sidestream could be suitable.

The heart-cut naphtha fraction is withdrawn from the separation zone via line 12 and introduced into reforming zone 20. The reforming zone upgrades the octane number of the reforming feed through a variety of reactions including naphthene dehydrogenation and paraffin dehydrocyclization and isomerization. It is within the scope of the invention that the reforming zone also processes heavy synthesis naphtha from the hereinafter-described selective-isoparaffin-synthesis zone. Product reformate passes through line 31 to gasoline blending.

Reforming operating conditions used in the reforming zone of the present invention include a pressure of from about atmospheric to 60 atmospheres (absolute), with the preferred range being from atmospheric to 20 atmospheres and a pressure of below 10 atmospheres being especially preferred. Hydrogen is supplied to the reforming zone in an amount sufficient to correspond to a ratio of from about 0.1 to 10 moles of hydrogen per mole of hydrocarbon feedstock. The volume of the contained reforming catalyst corresponds to a liquid hourly space velocity of from about 1 to 40 $hr^{-1}$. The operating temperature generally is in the range of 260° to 560° C.

The reforming catalyst comprises a supported platinum-group metal component. This component comprises one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The preferred platinum component generally comprises from about 0.01 to 2 mass % of the catalytic composite, preferably 0.05 to 1 mass %, calculated on an elemental basis.

It is within the scope of the present invention that the catalyst may contain other metal components known to modify the effect of the preferred platinum component. Such metal modifiers may include Group IVA (14) metals, other Group VIII (8-10) metals, rhenium, indium, gallium, zinc, uranium, dysprosium, thallium and mixtures thereof. A preferred metal modifier is a tin component. Catalytically effective amounts of such metal modifiers may be incorporated into the catalyst by any means known in the art.

The reforming catalyst conveniently is a dual-function composite containing a metallic hydrogenation-dehydrogenation component on a refractory support which provides acid sites for cracking and isomerization. The refractory support of the reforming catalyst should be a porous, adsorptive, high-surface-area material which is uniform in composition without composition gradients of the species inherent to its composition. Within the scope of the present invention are refractory supports containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) non-zeolitic molecular sieves as disclosed in U.S. Pat. No. 4,741,820, incorporated by reference; (5) spinels such as $MgAl_2O_4$, $FeAl_2O_4$, $ZnAl_2O_4$, $CaAl_2O_4$; and (6) combinations of materials from one or more of these groups.

The preferred refractory support for the reforming catalyst is alumina, with gamma- or eta-alumina being particularly preferred. Best results are obtained with an alumina is that which has been characterized in U.S. Pat. Nos. 3,852,190 and 4,012,313 as a byproduct from a Ziegler higher alcohol synthesis reaction as described in Ziegler's U.S. Pat. No. 2,892,858. For purposes of simplification, such an alumina will be hereinafter referred to as a "Ziegler alumina." Ziegler alumina is presently available from the Vista Chemical Company under the trademark "Catapal" or from Condea Chemie GMBH under the trademark "Pural." This material is an extremely high purity pseudo-boehmite powder which, after calcination at a high temperature, has been shown to yield a high-purity gamma-alumina.

The alumina powder may be formed into any shape or form of carrier material known to those skilled in the art such as spheres, extrudates, rods, pills, pellets, tablets or granules. Preferred spherical particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps. The alternative extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass %. The resulting dough is extruded through a suitably shaped and sized die to form extrudate particles, which are dried and calcined by known methods. Alternatively, spherical particles can be formed from the extrudates by rolling the extrudate particles on a spinning disk.

The reforming catalyst optimally contains a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 mass %, calculated on an elemental basis, of the final catalyst.

Further details of the preparation and activation of embodiments of the above reforming catalyst are disclosed in U.S. Pat. No. 4,677,094 (Moser et al.), which is incorporated into this specification by reference thereto.

In an advantageous alternative embodiment, the reforming catalyst comprises a large-pore molecular sieve. The term "large-pore molecular sieve" is defined as a molecular sieve having an effective pore diameter of about 7angstroms or larger. Examples of large-pore molecular sieves which might be incorporated into the present catalyst include LTL, FAU, AFI and MAZ (IUPAC Commission on Zeolite Nomenclature) and zeolite-beta.

Preferably the alternative embodiment of the reforming catalyst contains a nonacidic L-zeolite (LTL) and an alkali-metal component as well as a platinum-group metal component. It is essential that the L-zeolite be nonacidic, as acidity in the zeolite lowers the selectivity to aromatics of the finished catalyst. In order to be "nonacidic," the zeolite has substantially all of its cationic exchange sites occupied by nonhydrogen species. Preferably the cations occupying the exchangeable cation sites will comprise one or more of the alkali metals, although other cationic species may be present. An especially preferred nonacidic L-zeolite is potassium-form L-zeolite.

It is necessary to composite the L-zeolite with a binder in order to provide a convenient form for use in the catalyst of the present invention. The art teaches that any refractory inorganic oxide binder is suitable. One or more of silica, alumina or magnesia are preferred binder materials of the present invention. Amorphous silica is especially preferred, and excellent results are obtained when using a synthetic white silica powder precipitated as ultra-fine spherical particles from a water solution. The silica binder preferably is nonacidic, contains less than 0.3 mass % sulfate salts, and has a BET surface area of from about 120 to 160 $m^2g$.

The L-zeolite and binder may be composited to form the desired catalyst shape by any method known in the art. For example, potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the first reforming catalyst.

An alkali metal component is an essential constituent of the alternative reforming catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the nonacidic L-zeolite. Surface-deposited alkali metal also may be present as described in U.S. Pat. No. 4,619,906, incorporated herein by reference thereto.

Further details of the preparation and activation of embodiments of the alternative reforming catalyst are disclosed, e.g., in U.S. Pat. No. 4,619,906 (Lambert et al) and U.S. Pat. No. 4,822,762 (Ellig et al.), which are incorporated into this specification by reference thereto.

The final reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained.

The naphtha feedstock may contact the reforming catalyst in either upflow, downflow, or radial-flow mode. Since the present reforming process operates at relatively low pressure, the low pressure drop in a radial-flow reactor favors the radial-flow mode.

The catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or: (4) a hybrid system with semiregenerative and continuous-regeneration provisions in the same unit. The preferred embodiment of the present invention is a moving-bed reactor with continuous catalyst regeneration, in order to realize high yields of desired $C_5+$ product at relatively low operating pressures associated with more rapid catalyst deactivation.

Total product from the reforming zone generally is processed in a fractional distillation column to separate normally gaseous components from reformate. It is within the scope of the invention also to separate a light reformate from a heavy reformate by fractional distillation. Preferably, the light reformate will comprise pentanes either with or without a substantial concentration of $C_6$ hydrocarbons, and may be sent to an isomerization zone along with light naphtha.

The heavy naphtha fraction is withdrawn from the separation zone via line 13 and introduced into selective-isoparaffin-synthesis zone 30. This zone contains an active, selective isoparaffin-synthesis catalyst which permits operating pressures and temperatures to be used which are significantly below those employed in conventional hydrocracking. Heavier components of the naphtha are converted in the presence of hydrogen with minimum formation of light hydrocarbon gases such as methane and ethane. Side chains are cracked from heavier cyclic compounds while retaining naphthenic rings. Heavy paraffins are converted to yield a high proportion of isobutane, useful for production of alkylate or ethers for gasoline blending. Lighter paraffins such as pentanes and hexanes are formed in the process with a high proportion of higher-octane branched-chain isomers, and the isopentane/normal-pentane ratio is in excess of that which usually would be obtained by pentane isomerization. The overall effect is that the molecular weight and final boiling point of the hydrocarbons are reduced, the concentration of cyclics is retained, and the content of isoparaffins is increased significantly in synthesis effluent relative to the naphtha feedstock. A synthesis effluent leaves the selective-isoparaffin-synthesis zone 30 via line 31.

Selective-isoparaffin-synthesis operating conditions vary according to the characteristics of the feedstock and the product objectives. Operating pressure may range between about 10 atmospheres and 100 atmospheres gauge, and preferably between about 20 and 70 atmospheres. Temperature is selected to balance conversion, which is promoted by higher temperatures, against selectivity and favorable isomerization equilibrium which are favored by lower temperatures; operating temperature generally is between about 50° and 450° C., more usually between about 50° and 350° C. and preferably between about 100 and 300° C. Catalyst is loaded into the reactors of the selective-isoparaffin-synthesis process to provide a liquid hourly space velocity of between about 0.5 and 20, and more usually between about 1.0 and 10. The operating conditions generally will be sufficient to effect a yield of at least 8 volume % butanes, and preferably about 15 volume % or more, from the selective-isoparaffin-synthesis zone relative to the heavy naphtha fraction fed to the zone.

Hydrogen is supplied to the reactors of the selective isoparaffin-synthesis process not only to provide for hydrogen consumed in cracking, saturation and other reactions but also to maintain catalyst stability. The hydrogen may be partially or totally supplied from outside the process, and a substantial proportion of the requirement may be provided by hydrogen recycled after separation from the reactor effluent. The molar ratio of hydrogen to naphtha feedstock ranges usually from about 0.1 to 10. In an alternative embodiment, the hydrogen-to-hydrocarbon mole ratio in the reactor effluent is about 0.05 or less; this deviates the need to recycle hydrogen from the reactor effluent to the feed.

The selective-isoparaffin-synthesis zone contains a solid acid selective isoparaffin-synthesis catalyst. The acid component may be, for example, a halide, such as aluminum chloride; a zeolite, such as mordenite; a mineral acid such as $H_2SO_4$ or a solid strong acid such as sulfate incorporated into a support such as zirconia (U.S. Pat. No. 5,036,035). Suitable zeolites, in addition to MOR, include FAU, LTL, MAZ, MEL, MFI, and MTW (IUPAC Commission on Zeolite Nomenclature) and Beta; such zeolites are known in the art, e.g., U.S. Pat. Nos. 4,083,886 and 4,826,801 (MOR), U.S. Pat. Nos. 3,130,007 and 4,401,556 (FAU), U.S. Pat. Nos. 3,216,789 and 4,503,023 (LTL), U.S. Pat. Nos. 4,241,036 and 5,192,727 (MAZ), U.S. Pat. No. 3,709,979 (MEL), U.S. Pat. No. 3,702,886 (MFI), U.S. Pat. No. 3,832,449 (MTW), and U.S. Pat. Nos. 3,308,069/Re 28,341 and 5,095,169 (Beta), all of which are incorporated herein by reference. In addition to MOR, FAU, MAZ and Beta are preferred.

Generally the catalyst will contain a refractory inorganic oxide as described hereinbelow, with alumina or zirconia being particularly preferred. The selective isoparaffin-synthesis catalyst is effective in producing a superequilibrium concentration of isobutane in butanes produced in the selective-isoparaffin-synthesis zone at selective-isoparaffin-synthesis conditions.

The selective isoparaffin-synthesis catalyst preferably comprises an inorganic-oxide support, an acid component and a Group VIII (8-10) metal component. The refractory inorganic-oxide support optimally is a porous, adsorptive, high-surface-area support having a surface area of about 25 to about 500 $m^2/g$. The porous carrier material should also be uniform in composition and relatively refractory to the conditions utilized in the process. By the term "uniform in composition," it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention refractory inorganic oxides such as alumina, titania, zirconia, chromia, zinc oxide, magnesia, thoria, boria, silica-alumina, silica-magnesia, chromia-alumina, alumina-boria, silica-zirconia and other mixtures thereof. The selective isoparaffin-synthesis catalyst optionally also may contain one or more of the crystalline zeolitic aluminosilicates and non-zeolitic molecular sieves described hereinabove.

The preferred refractory inorganic oxide will have an apparent bulk density of about 0.3 to about 1.01 g/cc and surface area characteristics such that the average pore diameter is about 20 to 300 angstroms, the pore volume is about 0.05 to about 1 cc/g, and the surface area is about 50 to about 500 $m^2/g$. The preferred refractory inorganic oxide for use in the present invention is alumina. Suitable alumina materials are the crystalline aluminas known as the gamma-, eta-, and theta-alumina, with gamma- or eta-alumina giving best results. "Ziegler alumina" as described above in connection with the reforming catalyst is especially preferred.

The alumina powder may be formed into a suitable catalyst material according to any of the techniques known to those skilled in the catalyst-carrier-forming art. Spherical carrier particles may be formed, for example, from this Ziegler alumina by (1) converting the alumina powder into an alumina sol by reaction with a suitable peptizing acid and water and thereafter dropping a mixture of the resulting sol and a gelling agent into an oil bath to form spherical particles of an alumina gel which are easily converted to a gamma-alumina carrier material by known methods; (2) forming an extrudate from the powder by established methods and thereafter rolling the extrudate particles on a spinning disk until spherical particles are formed which can then be dried and calcined to form the desired particles of spherical carrier material; and (3) wetting the powder with a suitable peptizing agent and thereafter rolling the particles of the powder into spherical masses of the desired size. This alumina powder can also be formed in any other desired shape or type of carrier material known to those skilled in the art such as rods, pills, pellets, tablets, granules, extrudates, and like forms by methods well known to the practitioners of the catalyst material forming art.

The preferred form of carrier material for the selective isoparaffin-synthesis catalyst is a cylindrical extrudate. The extrudate particle is optimally prepared by mixing the alumina powder with water and suitable peptizing agents such as nitric acid, acetic acid, aluminum nitrate, and the like material until an extrudable dough is formed. The amount of water added to form the dough is typically sufficient to give a Loss on Ignition (LOI) at 500° C. of about 45 to 65 mass %, with a value of 55 mass % being especially preferred. The resulting dough is then extruded through a suitably sized die to form extrudate particles.

The extrudate particles are dried at a temperature of about 150° to about 200° C., and then calcined at a temperature of about 450° to 800° C. for a period of 0.5 to 10 hours to effect the preferred form of the refractory inorganic oxide. It is preferred that the refractory inorganic oxide comprise substantially pure gamma alumina having an apparent bulk density of about 0.6 to about 1 g/cc and a surface area of about 150 to 280 $m^2/g$ (preferably 185 to 235 $m^2/g$, at a pore volume of 0.3 to 0.8 cc/g).

An essential component of the preferred selective isoparaffin-synthesis catalyst is a platinum-group metal or nickel. Of the preferred platinum group, i.e., platinum, palladium, rhodium, ruthenium, osmium and iridium, palladium is a favored component and platinum is especially preferred. Mixtures of platinum-group metals also are within the scope of this invention. This component may exist within the final catalytic composite as a compound such as an oxide, sulfide, halide, or oxyhalide, in chemical combination with one or more of the other ingredients of the composite, or as an elemental metal. Best results are obtained when substantially all of this metal component is present in the elemental state. This component may be present in the final catalyst composite in any amount which is catalytically effective, and generally will comprise about 0.01 to 2 mass % of the final catalyst calculated on an elemental basis. Excellent results are obtained when the catalyst contains from about 0.05 to 1 mass % of platinum.

The platinum-group metal component may be incorporated into the selective isoparaffin-synthesis catalyst in any suitable manner such as coprecipitation or cogellation with the carrier material, ion exchange or impregnation. Impregnation using water-soluble compounds of the metal is preferred. Typical platinum-group compounds which may be employed are chloroplatinic acid, ammonium chloroplatinate, bromoplatinic acid, platinum dichloride, platinum tetrachloride hydrate, tetraamine platinum chloride, tetraamine platinum nitrate, platinum dichlorocarbonyl dichloride, dinitrodiaminoplatinum, palladium chloride, palladium chloride dihydrate, palladium nitrate, etc. Chloroplatinic acid is preferred as a source of the especially preferred platinum component.

It is within the scope of the present invention that the catalyst may contain other metal components known to modify the effect of the platinum-group metal component. Such metal modifiers may include rhenium, tin, germanium, lead, cobalt, nickel, indium, gallium, zinc, uranium, dysprosium, thallium, and mixtures thereof. Catalytically effective amounts of such metal modifiers may be incorporated into the catalyst by any means known in the art.

The composite, before addition of the optional Friedel-Crafts metal halide, is dried and calcined. The drying is carried out at a temperature of about 100° to 300°, followed by calcination or oxidation at a temperature of from about 375° to 600° C. in an air or oxygen atmosphere for a period of about 0.5 to 10 hours in order to convert the metallic components substantially to the oxide form.

The resultant oxidized catalytic composite is subjected to a substantially water-free and hydrocarbon-free reduction step. This step is designed to selectively reduce the platinum-group component to the corresponding metal and to insure a finely divided dispersion of the metal component throughout the carrier material. Substantially pure and dry hydrogen (i.e., less than 20 vol. ppm $H_2O$) preferably is used as the reducing agent in this step. The reducing agent is contacted with the oxidized composite at conditions including a temperature of about 425° C. to about 650° C. and a period of time of about 0.5 to 2 hours to reduce substantially all of the platinum-group metal component to its elemental metallic state.

Suitable metal halides comprising the optional Friedel-Crafts metal component of the selective isoparaffin-synthesis catalyst include aluminum chloride, aluminum bromide, ferric chloride, ferric bromide, zinc chloride and the like compounds, with the aluminum halides and particularly aluminum chloride ordinarily yielding best results. Generally, this component can be incorporated into the catalyst of the present invention by way of the conventional methods for adding metallic halides of this type; however, best results are ordinarily obtained when the metallic halide is sublimed onto the surface of the support according to the preferred method disclosed in U.S. Pat. No. 2,999,074, which is incorporated herein by reference.

As aluminum chloride sublimes at about 184° C., suitable preparation temperatures range from about 190° C. to 750° C. with a preferable range being from about 500° C. to 650° C. The sublimation can be conducted at atmospheric pressure or under increased pressure and in the presence of absence of diluent gases such a hydrogen or light paraffinic hydrocarbons or both. The impregnation of the Friedel-Crafts metal halide may be conducted batch-wise, but a preferred method for impregnating the calcined support is to pass sublimed $AlCl_3$ vapors, in admixture with a carrier gas such as hydrogen, through a bed of reduced catalyst. This method both continuously deposits and reacts the aluminum chloride and also removes hydrogen chloride evolved during the reaction.

The amount of optional Friedel-Crafts metal halide combined with the calcined support may range from about 1 up to 15 mass % relative to the calcined composite prior to introduction of the metal-halide component. The composite containing the sublimed Friedel-Crafts metal halide is treated to remove the unreacted Friedel-Crafts metal halide by subjecting the composite to a temperature above the sublimation temperature of the Friedel-Crafts metal halide, preferably below about 750° C., for a time sufficient to remove any unreacted metal halide in the case of $AlCl_3$, temperatures of about 500° C. to 650° C. and times of from about 1 to 48 hours are preferred.

Another optional component of the preferred catalyst is an organic polyhalo component. In this embodiment, the composite is further treated preferably after introduction of the Friedel-Crafts metal halide in contact with a polyhalo compound containing at least 2 chlorine atoms and selected from the group consisting of methylene halide, haloform, methylhaloform, carbon tetrahalide, sulfur dihalide, sulfur halide, thionyl halide, and thiocarbonyl tetrahalide. Suitable polyhalo compounds thus include methylene chloride, chloroform, methylchloroform, carbon tetrachloride, and the like. In any case, the polyhalo compound must contain at least two chlorine atoms attached to the same carbon atom. Carbon tetrachloride is the preferred polyhalo compound. The composite contacts the polyhalo compound preferably diluted in a non-reducing gas such as nitrogen, air, oxygen and the like. The contacting suitably is effected at a temperature of from about 100° to 600° C. over a period of from about 0.2 to 5 hours to add at least 0.1 mass % combined halogen to the composite.

The catalyst of the present invention may contain an additional halogen component. The halogen component may be either fluorine, chlorine, bromine or iodine or mixtures thereof with chlorine being preferred. The halogen component is generally present in a combined state with the inorganic-oxide support. The halogen component may be incorporated in the catalyst in any suitable manner, either during the preparation of the inorganic-oxide support or before, while or after other catalytic components are incorporated. For example, chloroplatinic acid may be used in impregnating a platinum component. The halogen component is preferably well dispersed throughout the catalyst and may comprise from more than 0.2 to about 15 mass %, calculated on an elemental basis, of the final catalyst.

Water and sulfur are catalyst poisons especially for the chlorided platinum-alumina catalyst composition described hereinabove. Water can act to permanently deactivate the catalyst by removing high-activity chloride from the catalyst and replacing it with inactive aluminum hydroxide. Therefore, water and oxygenates that can decompose to form water can only be tolerated in very low concentrations. In general, this requires a limitation of oxygenates in the feed to about 0.1 ppm or less. Sulfur present in the feedstock serves to temporarily deactivate the catalyst by platinum poisoning. If sulfur is present in the feed, activity of the catalyst may be restored by hot hydrogen stripping of sulfur from the catalyst composition or by lowering the sulfur concentration in the incoming feed to below 0.5 ppm. The feed may be treated by any method that will remove water and sulfur compounds. Sulfur may be removed from the feed stream by hydrotreating. Adsorption systems for the removal of sulfur and water from hydrocarbon streams are well known to those skilled in the art.

The chlorided platinum-alumina catalyst described hereinabove also requires the presence of a small amount of an organic chloride promoter in the selective-isoparaffin-synthesis zone. The organic chloride promoter serves to maintain a high level of active chloride on the catalyst, as low levels are continuously stripped off the catalyst by the hydrocarbon feed. The concentration of promoter in the combined feed is maintained at from 30 to 300 mass ppm. The preferred promoter compound is carbon tetrachloride. Other suitable promoter compounds include oxygen-free decomposable organic chlorides such as propyldichloride, butylchloride, and chloroform, to name only a few of such compounds. The need to keep the reactants dry is reinforced by the presence of the organic chloride compound which may convert, in part, to hydrogen chloride. As long as the hydrocarbon feed and hydrogen are dried as described hereinabove, there will be no adverse effect from the presence of small amounts of hydrogen chloride.

Contacting within the selective-isoparaffin-synthesis zone may be effected using the catalyst in a fixed-bed system, a moving-bed system, a fluidized-bed system, or in a batch-type operation. In view of the danger of attrition loss of the valuable catalyst and of operational advantages, it is preferred to use a fixed-bed system. In this system, a hydrogen-rich gas and the charge stock are preheated by suitable heating means to the desired reaction temperature and then passed into an selective-isoparaffin-synthesis zone containing a fixed bed of the catalyst particle as previously characterized. The selective-isoparaffin-synthesis zone may be in a single reactor or in two or more separate reactors with suitable means therebetween to ensure that the desired selective-isoparaffin-synthesis temperature is maintained at the entrance to each reactor. Two or more reactors in sequence are preferred to control individual reactor temperatures in light of the exothermic heat of reaction and for partial catalyst replacement without a process shutdown. The reactants may be contacted with the bed of catalyst particles in either upward, downward, or radial flow fashion. The reactants may be in the liquid phase, a mixed liquid-vapor phase, or a vapor phase when contacted with the catalyst particles.

Preferably the reforming zone and the isoparaffin-synthesis zone are heat-integrated to minimize external heating and cooling requirements. For example, the effluent from the last reforming reactor may be heat-exchanged with combined feed to the isoparaffin synthesis; the temperature differential generally is sufficient to heat the isoparaffin-synthesis feed to the required reactor-inlet temperature without external heating. The heat of reaction of selective isoparaffin synthesis may be used to heat reforming feed through heat exchange.

The selective-isoparaffin-synthesis zone generally includes a separation section, optimally comprising one or more fractional distillation columns having associated appurtenances. The separation zone typically processes a synthesis effluent obtained from the reaction to yield an isobutane-rich stream, a light synthesis naphtha and a heavy synthesis naphtha.

The isobutane-rich stream, or isobutane concentrate, has a concentration of between about 70 and 95 mole % isobutane in total butanes and more usually in excess of 80 mole % isobutane. Optionally, an isopentane-rich stream may be recovered from the synthesis effluent either in admixture with the isobutane or as a separate stream. However, the isopentane produced in the selective-isoparaffin-synthesis zone usually is recovered in the light synthesis naphtha. The isobutane-rich stream may be further upgraded via dehydrogenation and etherification or alkylation, as described hereinafter.

The light synthesis naphtha normally comprises pentanes and hexanes in admixture, and also may contain smaller concentrations of naphthenes, benzene and $C_7$ hydrocarbons. Usually over 80 mole %, and preferably over 90 mole %, of the $C_6$ hydrocarbons in the synthesis effluent are contained in the light synthesis naphtha; $C_6$ hydrocarbons directed to the heavy synthesis naphtha and subsequently reformed would be partially converted to benzene, which is undesirable in gasoline for environmental reasons.

The heavy synthesis naphtha may be sent directly to gasoline blending, or preferably is a favorable supplementary feed to the reforming zone.

Optionally, part or all of the isobutane-rich stream is sent to a dehydrogenation zone. In the dehydrogenation zone, isobutane is converted selectively to isobutene as feed to etherification and/or alkylation. Optionally, part or all of the isopentane also is dehydrogenated to yield isopentene as additional etherification feed.

Dehydrogenation conditions generally include a pressure of from about 0 to 35 atmospheres, more usually no more than about 5 atmospheres. Suitable temperatures range from about 480° C. to 760° C., optimally from about 540° C. to 705° C. when processing a light liquid comprising isobutane and/or isopentane. Catalyst is available in dehydrogenation reactors to provide a liquid hourly space velocity of from about 1 to 10, and preferably no more than about 5. Hydrogen is admixed with the hydrocarbon feedstock in a mole ratio of from about 0.1 to 10, and more usually from about 0.5 to 2.

The dehydrogenation catalyst comprises a platinum-group metal component, preferably a platinum component, and an alkali-metal component on a refractory support. The alkali-metal component is chosen from cesium, rubidium, potassium, sodium, and lithium. The catalyst also may contain promoter metals, preferably tin in an atomic ratio of tin to platinum be between 1:1 and about 6:1. The refractory support of the dehydrogenation catalyst should be a porous, absorptive high-surface-area material as delimited hereinabove for the reforming catalyst. A refractory inorganic oxide is the preferred support, with alumina being particularly preferred.

A suitable dehydrogenation reaction zone for this invention preferably comprises one or more radial-flow reactors through which the catalyst gravitates downward with continuous removal of spent catalyst. A detailed description of the moving-bed reactors herein contemplated may be obtained by reference to U.S. Pat. No. 3,978, 150. Preferably, the dehydrogenation reactor section comprises multiple stacked or side-by-side reactors, and a combined stream of hydrogen and hydrocarbons is processed serially through the multiple reactors each of which contains a particulate catalyst disposed as an annular-form downwardly moving bed. The moving catalyst bed permits a continuous addition of fresh and/or regenerated catalyst and the withdrawal of spent catalyst, and is illustrated in U.S. Pat. No. 3,647,680. Since the dehydrogenation reaction is endothermic in nature, intermediate heating of the reactant stream between zones is the optimal practice.

The dehydrogenation zone will produce a near-equilibrium mixture of the desired isoolefin and its isoalkane precursor. Preferably an isobutane-rich stream is processed to yield an isobutene-containing stream. Alternatively or additionally, an isopentene-containing stream is produced from and isopentane-rich stream. A separation section recovers hydrogen from the effluent for use elsewhere.

Preferably part or all of an olefin-containing product stream from the dehydrogenation zone is used to produce ethers in an etherification zone. The olefin-containing stream preferably contains isobutene, and optionally comprises isopentene. In addition, one or more monohydroxy alcohols are fed to the etherification zone. Ethanol is a preferred monohydroxy-alcohol feed, and methanol is especially preferred. This variety of possible feed materials allows the production of a variety of ethers in addition to or instead of the preferred methyl tertiary-butyl ether (MTBE). These useful ethers include ethyl tertiary butyl ether (ETBE), methyl tertiary amyl ether (MTAE) and ethyl tertiary amyl ether (ETAE).

Processes operating with vapor, liquid or mixed-phase conditions may be suitably employed in this invention. The preferred etherification process uses liquid-phase etherification conditions, including a superatmospheric pressure sufficient to maintain the reactants in liquid phase but no more than about 50 atmospheres; even in the presence of additional light materials, pressures in the range of 10 to 40 atmospheres generally are sufficient to maintain liquid-phase conditions. Operating temperature is between about 30° C. and 100° C.; the reaction rate is normally faster at higher temperatures, but conversion is more complete at lower temperatures. High conversion in a moderate volume reaction zone can, therefore, be obtained if the initial section of the reaction zone, e.g., the first two-thirds, is maintained above 70° C. and the remainder of the reaction zone is maintained below 50° C. This may be accomplished most easily with two reactors.

The ratio of feed alcohol to isoolefin should normally be maintained in the broad range of 1:1 to 2:1. With the preferred reactants, good results are achieved if the ratio of methanol to isobutene is between 1.05:1 and 1.5:1. An excess of methanol, above that required to achieve satisfactory conversion at good selectivity, should be avoided as some decomposition of methanol to dimethylether may occur with a concomitant increase in the load on separation facilities.

A wide range of materials are known to be effective as etherification catalysts including mineral acids such as sulfuric acid, boron trifluoride, phosphoric acid on kieselguhr, phosphorus-modified zeolites, heteropoly acids, and various sulfonated resins. The use of a sulfonated solid resin catalyst is preferred. These resin type catalysts include the reaction products of phenolformaldehyde resins and sulfuric acid and sulfonated polystyrene resins including those cross-linked with divinylbenzene. Further information on suitable etherification catalysts may be obtained by reference to U.S. Pat. Nos. 2,480,940, 2,922,822, and 4,270,929 and the previously cited etherification references.

In the preferred etherification process for the production of MTBE, essentially all of the isobutene is converted to MTBE thereby eliminating the need for subsequently separating that olefin from isobutane. As a result, downstream separation facilities are simplified. Several suitable etherification processes have been described in the literature which presently are being used to produce MTBE. The preferred form of the etherification zone is similar to that described in U.S. Pat. No. 4,219,678. In this instance, the isobutene, methanol and a recycle stream containing recovered excess alcohol are passed into the etherification zone and contacted at etherification conditions with an acidic etherification catalyst to produce an effluent containing MTBE.

The effluent from the etherification-zone reactor section includes at least product ethers, light hydrocarbons, dehydrogenatable hydrocarbons, and any excess alcohol. The effluent may also include small amounts of hydrogen and of other oxygen-containing compounds such as dimethyl ether and TBA. The effluent passes from the etherification reactor section to a separation section for the recovery of product. The etherification effluent is separated to recover the ether product, preferably by fractional distillation with ether being taken as bottoms product; this product generally is suitable for gasoline blending but may be purified further, e.g., by azeotropic distillation.

The overhead from ether separation containing unreacted hydrocarbons is passed through a methanol recovery zone for the recovery of methanol, preferably by adsorption, with return of the methanol to the etherification reactor section. The hydrocarbon-rich stream is fractionated to remove $C_3$ and lighter hydrocarbons and oxygenates from the stream of unreacted $C_4$–$C_5$ hydrocarbons. Heavier oxygenate compounds are removed by passing the stream of unreacted hydrocarbons through a separate oxygenate recovery unit. This hydrocarbon raffinate, after oxygenate removal, may be dehydrogenated to provide additional feedstock for the etherification zone or used as part of the feed to an alkylation reaction zone to produce high octane alkylate.

A portion of the isobutane-rich stream from the separation zone and a portion of the iso-olefin-containing stream from the dehydrogenation zone may be processed in an alkylation zone. The alkylation zone optionally may process other isobutane- or olefin-containing streams from an associated petroleum refinery.

The optional alkylation zone of this invention may be any acidic catalyst reaction system such as a hydrogen fluoride-catalyzed system, sulfuric-acid system or one which utilizes an acidic catalyst in a fixed-bed reaction system. Hydrogen fluoride alkylation is particularly preferred, and may be conducted substantially as set forth in U.S. Pat. No. 3,249,650. The alkylation reaction in the presence of hydrogen fluoride catalyst is conducted at a catalyst to hydrocarbon volume ratio within the alkylation reaction zone of from about 0.2 to 2.5 and preferably about 0.5 to 1.5. Ordinarily, anhydrous hydrogen fluoride will be charged to the alkylation system as fresh catalyst; however, it is possible to utilize hydrogen fluoride containing as much as 10.0% water or more. Excessive dilution with water is generally to be avoided since it tends to reduce the alkylating activity of the catalyst and further introduces corrosion problems. In order to reduce the tendency of the olefinic portion of the charge stock to undergo polymerization prior to alkylation, the molar proportion of isoparaffins to olefinic hydrocarbons in an alkylation reactor is desirably maintained at a value greater than 1.0, and preferably from about 3.0 to 15.0. Alkylation reaction conditions, as catalyzed by hydrogen fluoride, include a temperature of from −20° to about 100° C., and preferably from about 0° to 50° C. The pressure maintained within the alkylation system is ordinarily at a level sufficient to maintain the hydrocarbons and catalyst in a substantially liquid phase; that is, from about atmospheric to 40 atmospheres. The contact time within the alkylation reaction zone is conveniently expressed in terms of space-time, being defined as the volume of catalyst within the reactor contact zone divided by the volume rate per minute of hydrocarbon reactants charged to the zone. Usually the space-time will be less than 30 minutes and preferably less than about 15 minutes.

Alkylate recovered from the alkylation zone generally comprises n-butane and heavier components, isobutane and lighter materials having been removed by fractionation and returned to the reactor. At least a portion, and preferably all, of the alkylate is blended into the present gasoline component.

The optional light naphtha fraction recovered from the separation zone 10 via line 14 may pass to an isomerization zone for upgrading of its octane number. Light reformate also may be separated from the stabilized reformate and sent to the isomerization zone. It also is within the scope of the invention that a portion of the light naphtha fraction, especially the $C_6$ portion, is isomerized in the isomerization zone. At least the $C_5$ portion already generally comprises an isopentane/n-pentane ratio in excess of equilibrium at usual isomerization conditions.

Isomerization conditions in the isomerization zone include reactor temperatures usually ranging from about 40° to 250° C. Lower reaction temperatures are generally preferred wherein the equilibrium favors higher concentrations of isoalkanes relative to normal alkanes. Lower temperatures are particularly desirable in order to favor equilibrium mixtures having the highest concentration of high-octane highly branched isoalkanes and to minimize cracking of the feed to lighter hydrocarbons. Temperatures in the range of from about 400° to about 150° C. are preferred in the present invention.

Reactor operating pressures generally range from about atmospheric to 100 atmospheres, with preferred pressures in the range of from 20 to 35 atmospheres. Liquid hourly space velocities range from about 0.25 to about 12 volumes of isomerizable hydrocarbon feed per hour per volume of catalyst, with a range of about 0.5 to 5 $hr^{-1}$ being preferred.

Hydrogen is admixed with the feed to the isomerization zone to provide a mole ratio of hydrogen to hydrocarbon feed of about 0.01 to 5. The hydrogen may be supplied totally from outside the process or supplemented by hydrogen recycled to the feed after separation from reactor effluent. Light hydrocarbons and small amounts of inerts such as nitrogen and argon may be present in the hydrogen. Water should be removed from hydrogen supplied from outside the process, preferably by an adsorption system as is known in the art. In a preferred embodiment the hydrogen to hydrocarbon mole ratio in the reactor effluent is equal to or less than 0.05, generally obviating the need to recycle hydrogen from the reactor effluent to the feed.

Any catalyst known in the art to be suitable for the isomerization of paraffin-rich hydrocarbon streams may be used as an isomerization catalyst in the isomerization zone. One suitable isomerization catalyst comprises a platinum-group metal, hydrogen-form crystalline aluminosilicate and a refractory inorganic oxide. Best isomerization results are obtained when the composition has a surface area of at least 580 $m^2/g$. The preferred noble metal is platinum which is present in an amount of from about 0.01 to 5 mass % of the composition, and optimally from about 0.15 to 0.5 mass %. Catalytically effective amounts of one or more promoter metals preferably selected from Groups VIB(6), VIII(8-10), IB(11), IIB(12), IVA(14), rhenium, iron, cobalt, nickel, gallium and indium also may be present.

The crystalline aluminosilicate may be synthetic or naturally occurring, and preferably is selected from the group consisting of FAU, LTL, MAZ and MOR with mordenite having a silica-to-alumina ratio of from 16:1 to 60:1 being especially preferred. The crystalline aluminosilicate generally comprises from about 50 to 99.5 mass % of the composition, with the balance being the refractory inorganic oxide. Alumina, and preferably one or more of gamma-alumina and eta-alumina, is the preferred inorganic oxide. Further details of the composition are disclosed in U.S. Pat. No. 4,735,929, incorporated herein by reference thereto.

A preferred isomerization catalyst composition comprises one or more platinum-group metals, a halogen, and an inorganic-oxide binder. Preferably the catalyst contains a Friedel-Crafts metal halide, with aluminum chloride being especially preferred. The optimal platinum-group metal is platinum which is present in an amount of from about 0.1 to 0.5 mass %. The composition may also contain an organic polyhalo component, with carbon tetrachloride being preferred, and the total chloride content is from about 2 to 10 mass %. The inorganic oxide preferably comprises alumina, with one or more of gamma-alumina and eta-alumina providing best results. Optimally, the carrier material is in the form of a calcined cylindrical extrudate. Other details, alternatives and preparation steps of the preferred isomerization catalyst are as presented hereinabove for the selective isoparaffin-synthesis catalyst. Optionally, the same catalyst may be used in the selective-isoparaffin-synthesis and isomerization zones. U.S. Pat. Nos. 2,999,074 and 3,031,419 teach additional aspects of this composition and are incorporated herein by reference.

Water and sulfur are catalyst poisons especially for the chlorided platinum-alumina catalyst composition described hereinabove. Water can act to permanently deactivate the catalyst by removing high-activity chloride from the catalyst and replacing it with inactive aluminum hydroxide. Therefore, water and oxygenates that can decompose to form water can only be tolerated in very low concentrations. In general, this requires a limitation of oxygenates in the feed to about 0.1 ppm or less. Sulfur present in the feedstock serves to temporarily deactivate the catalyst by platinum poisoning. The present isomerization feed is not expected to contain a significant amount of sulfur, since it has been derived from the selective-isoparaffin-synthesis zone. Adsorption systems for the removal of sulfur and water from hydrocarbon streams may be used to ensure low levels of these contaminants in the isomerization feed.

An organic chloride promoter is required to maintain a high level of active chloride on the preferred catalyst, as discussed hereinabove in relation to the preferred selective isoparaffin-synthesis catalyst. The concentration of promoter in the combined feed is maintained at from 30 to 300 mass ppm.

Contacting within the isomerization zone may be effected using the catalyst in a fixed-bed system, a moving-bed system, a fluidized-bed system, or in a batch-type operation. A fixed-bed system is preferred. The isomerization zone may be in a single reactor or in two or more separate reactors with suitable means therebetween to ensure that the desired isomerization temperature is maintained at the entrance to each zone. Two or more reactors in sequence are preferred to enable improved isomerization through control of individual reactor temperatures and for partial catalyst replacement without a process shutdown. The reactants may be contacted with the bed of catalyst particles in either upward, downward, or radial-flow fashion. The reactants may be in the liquid phase, a mixed liquid-vapor phase, or a vapor phase when contacted with the catalyst particles, with excellent results being obtained by application of the present invention to a primarily liquid-phase operation.

Isomerate recovered from once-through processing of light naphtha does contain some low-octane normal paraffins and intermediate-octane methylhexanes as well as the desired highest-octane isopentane and dimethylbutane. It is within the scope of the present invention that the product from the reactors of the isomerization process is subjected to separation and recycle of the lower-octane portion to the isomerization reaction. Low-octane normal paraffins are separated and recycled in this embodiment to obtain an iso-rich product, and less-branched hexanes also may be separated and recycled. Techniques to achieve this separation are well known in the art, and include fractionation and molecular-sieve adsorption.

Part or all of the stabilized reformate is blended with one or more of the synthesis effluent, reformed synthesis naphtha, light synthesis naphtha heavy synthesis naphtha, light naphtha fraction, and/or isomerized product to produce a gasoline component. Other optional constituents of the gasoline component are heavy and light reformate from fractionation of the reformate and an iso-rich product produced by subjecting the isomerate to fractionation and/or molecular sieve adsorption as discussed hereinabove.

Finished gasoline may be produced by blending the gasoline component with other constituents including but not limited to one or more of butanes, butenes, pentanes, naphtha, catalytic reformate, isomerate, alkylate, polymer, aromatic extract, heavy aromatics; gasoline from catalytic cracking, hydrocracking, thermal cracking, thermal reforming, steam pyrolysis and coking; oxygenates from sources outside the combination such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention.

The feedstock used in Examples 1–7 is a mixture of heavy straight naphtha and coker naphtha derived from Arabian Light crude oil having the following characteristics:

| | |
|---|---|
| Specific gravity | 0.758 |
| Distillation, ASTM D-86, °C. | |
| IBP | 93 |
| 50% | 137 |
| 90% | 168 |
| EP | 197 |
| Volume % | |
| paraffins | 63.3 |
| naphthenes | 19.2 |

-continued

| | |
|---|---|
| aromatics | 17.5 |
| Volume % | |
| $C_6$− | 0.4 |
| $C_7$ | 20.8 |
| $C_8$ | 27.0 |
| $C_9$ | 26.8 |
| $C_{10}$ | 16.7 |
| $C_{11}$+ | 8.3 |

EXAMPLE 1

The benefits of producing a gasoline component using the process combination of the invention are illustrated by contrasting results with those from processes of the prior art. Example 1 presents results based on the use of a prior-art process combination.

The prior art is illustrated by selective isoparaffin synthesis from the naphtha feedstock described above followed by fractionation of the effluent and reforming of the $C_7$ and heavier synthesis naphtha. Yields in the synthesis zone are based on the use of a platinum-$AlCl_3$-on-alumina catalyst as described hereinabove containing about 0.25 mass % platinum and 5.5 mass % chloride. Hydrogen consumption and product yields based on the processing of 3250 cubic meters per day are as follows:

| | |
|---|---|
| Hydrogen consumption, $10^3Nm^3$/day | 642 |
| Yields, $m^3$/day: | |
| Isobutane concentrate | 1339 |
| $C_5/C_6$ | 1098 |
| $C_7$+ | 1321 |

The isobutane concentrate ("Iso $C_4$ concentrate") comprises about 90% isobutane.

$C_7$+ product from selective isoparaffin synthesis is processed in a reforming unit. The reforming operation is carried out using each of two alternative catalyst types:

Case A: Conventional spherical platinum-tin-alumina

Case B: Platinum on potassium-form L-zeolite extrudate

Operating pressure in each case is about 3.4 atmospheres gauge, and the severity is 95 Research octane number (RON) clear on the $C_5$+ product. The low pressure provides high hydrogen and $C_5$+ yields. After stabilization of the reformate to remove the small amount of $C_4$ and lighter produced, the $C_5$+ is blended with $C_5/C_6$ from selective isoparaffin synthesis to obtain a gasoline component. Overall yields of the selective-isoparaffin-synthesis/reforming combination, considering hydrogen production in the reformer as well as consumption in the selective isoparaffin synthesis, are as follows:

| | Case: | |
|---|---|---|
| | A | B |
| Net $H_2$ consumption, $10^3Nm^3$/day | 267 | 203 |
| Yields, $m^3$/day: | | |
| Iso $C_4$ concentrate | 1339 | 1339 |
| $C_5$+ component | 2176 | 2163 |

EXAMPLE 2

The process combination of the invention is illustrated in Example 2. The Arabian Light naphtha as used in control Example 1 is fractionated to separate a 150° C. and heavier cut from a cut boiling up to about 150° C. in accordance with the Figure. The heavier naphtha is processed by selective isoparaffin synthesis followed by fractionation of the effluent to yield an isobutane concentrate, a $C_5/C_6$ fraction and heavy synthesis naphtha. Yields in the selective-isoparaffin-synthesis zone are based on the use of a platinum-$AlCl_3$-on-alumina catalyst as described hereinabove containing about 0.25 mass % platinum and 5.5 mass % chloride. Hydrogen consumption and product yields based on the processing of 3250 cubic meters per day are as follows:

| | |
|---|---|
| IBP-150° C. naphtha to reforming, $m^3$/day | 1552 |
| 150° C. and heavier naphtha to synthesis, $m^3$/day | 1698 |
| Hydrogen consumption, $10^3Nm^3$/day | 359 |
| Synthesis, yields, $m^3$/day: | |
| Iso$C_4$ concentrate | 704 |
| $C_5/C_6$ | 1056 |
| $C_7$+ | 230 |

The isobutane concentrate comprises about 90% isobutane.

The $C_7$+ synthesis naphtha is processed along with IBP-150° C. naphtha in a reforming unit. The reforming operation is carried out using an extruded catalyst comprising platinum on potassium-form L-zeolite at a pressure of about 3.4 atmospheres gauge and a severity of 95 Research octane number (RON) clear on the $C_5$+ product. After stabilization of the reformate to remove the small amount of $C_4$ and lighter produced, the $C_5$+ is blended with $C_5/C_6$ from selective isoparaffin synthesis to obtain a gasoline component. Overall yields of the selective-isoparaffin-synthesis/reforming combination, considering hydrogen production in the reformer as well as consumption in selective isoparaffin synthesis, are as follows from 3250 cubic meters/day of naphtha:

| | |
|---|---|
| Net $H_2$ production, $10^3Nm^3$/day | 143 |
| Yields, $m^3$/day: | |
| Iso$C_4$ concentrate | 704 |
| $C_5$+ component | 2540 |

Compared to Example 1 of the prior art, the corresponding case of the invention shows lower isobutane production but a greater $C_5$+ yield and net production rather than consumption of hydrogen.

EXAMPLE 3

Example 3 presents a reforming process of the prior art producing a gasoline component which has an unacceptable endpoint for current U.S. reformulated gasoline blends. The feedstock to the reforming process is the same Arabian Light naphtha used in Example 1. The reforming operation is carried out using a conventional spherical platinum-rhenium-on-alumina catalyst at a pressure of about 20 atmospheres gauge and a severity of 92 Research octane number (RON) clear on the $C_5$+ product.

Yields of hydrogen and $C_5$+ reformate and high-end distillation characteristics of the reformate are as follows:

| | |
|---|---|
| Net $H_2$ production, $10^3Nm^3$/day | 386 |
| Yields, $m^3$/day: | |
| $C_5$+ component | 2766 |

-continued

| | |
|---|---|
| $C_5$+ ASTM D-86: | |
| 90% point, °C. | 173 |
| End point, °C. | 214 |

EXAMPLE 4

Example 4 is another illustration of the prior art based on the selective isoparaffin synthesis of the naphtha feedstock described above followed by fractionation of the effluent and reforming of the $C_7$ and heavier synthesis naphtha using operating conditions in accordance with Example 3. Yields in the selective-isoparaffin-synthesis zone are identical to those of Example 1.

$C_7$ + product from selective isoparaffin synthesis is processed in a reforming unit. As in Example 3, the reforming operation is carried out using a conventional spherical platinum-rhenium-on-alumina catalyst at a pressure of about 20 atmospheres gauge and a severity of 92 Research octane number (RON) clear on the $C_5$+ product. After stabilization of the reformate to remove the small amount of $C_4$ and lighter produced, the $C_5$+ is blended with $C_5/C_6$ from selective isoparaffin synthesis to obtain a gasoline component. Overall yields of the selective-isoparaffin-synthesis/reforming combination, considering hydrogen production in the reformer as well as consumption in the selective isoparaffin synthesis and the high end distillation characteristics of the reformate, are as follows:

| | |
|---|---|
| Net $H_2$ consumption, $10^3Nm^3$/day | 361 |
| Yields, $m^3$/day: | |
| $IsoC_4$ concentrate | 1339 |
| $C_5$+ component | 2184 |
| $C_5$+ ASTM D-86: | |
| 90% point, °C. | 139 |
| End point, °C. | 165 |

EXAMPLE 5

Example 5 is an illustration of the process combination of the invention for comparison with prior-art Cases 3 and 4. The Arabian Light naphtha described hereinabove is fractionated to separate a 175° C. and heavier cut from a cut boiling up to about 175° C. in accordance with the Figure. The lighter cut contains 26 volume % $C_7$ and 34 volume % $C_8$ hydrocarbons. The 175° C. and heavier cut contains about 58 volume % $C_{10}$ hydrocarbons. The heavier naphtha is processed by selective isoparaffin synthesis followed by fractionation of the effluent to yield isobutane concentrate and a $C_5$+ synthesis product. Yields in the selective-isoparaffin-synthesis zone are based on the use of a platinum-$AlCl_3$-on-alumina catalyst as described hereinabove containing about 0.25 mass % platinum and 5.5 mass % chloride. Product yields from fractionation and synthesis are as follows:

| | |
|---|---|
| IBP - 175° C. naphtha to reforming, $m^3$/day | 2604 |
| 175° C. and heavier naphtha to synthesis, $m^3$/day | 646 |
| Hydrogen consumption, $10^3Nm^3$/day | 120 |
| Yields, $m^3$/day: | |
| $IsoC_4$ concentrate | 226 |
| $C_5$+ synthesis product | 537 |

The isobutane concentrate comprises about 90% isobutane.

The IBP-175° C. naphtha is processed in a reforming unit using a conventional spherical platinum-rhenium-on-alumina catalyst as in Example 3 at an operating pressure of about 20 atmospheres gauge and a severity of 92 Research octane number (RON) clear on the $C_5$+ product. After stabilization of the reformate to remove the small amount of $C_4$ and lighter produced, the $C_5$+ is blended with $C_5/C_6$ from selective isoparaffin synthesis to obtain a gasoline component. Overall yields of the selective-isoparaffin-synthesis/reforming combination, considering hydrogen production in the reformer as well as consumption in the selective isoparaffin synthesis, are as follows from 3250 cubic meters/day of naphtha:

| | |
|---|---|
| Net $H_2$ production, $10^3Nm^3$/day | 243 |
| Yields, $m^3$/day: | |
| $IsoC_4$ concentrate | 226 |
| $C_5$+ component | 2788 |
| $C_5$+ ASTM D-86: | |
| 90% point, °C. | 166 |
| End point, °C. | 193 |

EXAMPLE 6

Example 6 is another illustration of the process combination of the invention, based on a change in cut point between light and heavy naphtha. The Arabian Light naphtha described hereinabove is fractionated to separate a 160° C. and heavier cut from a cut boiling up to about 160° C. in accordance with the Figure. The lighter cut contains 34 volume % $C_7$ and 44 volume % $C_8$ hydrocarbons. The 160° C. and heavier cut contains about 43 volume % $C_{10}$ hydrocarbons. The heavier naphtha is processed by selective isoparaffin synthesis followed by fractionation of the effluent to yield products according to two different cases:

Case A: $IsoC_4$ concentrate and $C_5$+ synthesis product

Case B: $IsoC_4$ concentrate, $C_5/C_6$ fraction, heavy synthesis naphtha

Thus, the $C_5$+ product in Case B is separated into a $C_5/C_6$ cut to gasoline blending and a $C_7$+ fraction as reforming feed.

Yields in the selective-isoparaffin-synthesis zone are based on the use of a platinum-$AlCl_3$-on-alumina catalyst as described hereinabove containing about 0.25 mass platinum and 5.5 mass % chloride. Product yields from fractionation and synthesis are as follows:

| | |
|---|---|
| IBP - 160° C. naphtha to reforming, $m^3$/day | 1991 |
| 160° C. and heavier naphtha to synthesis, $m^3$/day | 1259 |
| Hydrogen consumption, $10^3Nm^3$/day | 260 |
| Yields, $m^3$/day: | |
| $IsoC_4$ concentrate | 456 |
| $C_5/C_6$ | 753 |
| $C_7$+ | 270 |

The isobutane concentrate comprises about 90% isobutane.

In Case A, the entire $C_5$+ effluent from selective isoparaffin synthesis is blended into the gasoline component and reforming feed consists of the Arabian Light naphtha cut boiling up to about 160° C. In Case B, the $C_7$+ synthesis naphtha is added to the feed to the reforming unit. The reforming operation is carried out using a conventional spherical platinum-rhenium-on-alumina catalyst as in Example 3 at a pressure of about 20 atmospheres gauge and a severity of 92 Research octane number (RON) clear on the $C_5+$ product. After stabilization of the reformate to remove the small amount of $C_4$ and lighter produced, the $C_5+$ is blended with $C_5/C_6$ from selective isoparaffin synthesis to obtain a gasoline component. Overall yields of the selective-isoparaffin-synthesis/reforming combination from 3250 cubic meters per day of naphtha, considering hydrogen production in the reformer as well as consumption in the selective isoparaffin synthesis, are as follows:

| | Case: | |
|---|---|---|
| | A | B |
| Net $H_2$ production, $10^3Nm^3$/day | −21 | 75 |
| Yields, $m^3$/day: | | |
| $IsoC_4$ concentrate | 456 | 456 |
| $C_5+$ component | 2695 | 2692 |
| $C_5+$ ASTM D-86: | | |
| 90% point, °C. | 144 | 148 |
| End point, °C. | 176 | 177 |

EXAMPLE 7

A comparison of the cases of Examples 3–6 shows the impact on yields of using the present invention to reduce the end point of a gasoline component, based on 3250 cubic meters per day of naphtha feed:

| | Example | | | | |
|---|---|---|---|---|---|
| | | | | 6 Case | |
| | 3 | 4 | 5 | A | B |
| Invention? | No | No | Yes | Yes | Yes |
| Synthesis feed, $m^3$/day | 0 | 3250 | 646 | 1259 | 1259 |
| Net $H_2$, $10^3Nm^3$/day | 386 | −361 | 243 | −21 | 75 |
| $IsoC_4 + C_5+$, $m^3$/day | 2766 | 3523 | 3014 | 3151 | 3148 |
| $C_5+$, $m^3$/day | 2766 | 2184 | 2788 | 2695 | 2692 |
| 90% point, °C. | 173 | 139 | 166 | 144 | 148 |
| End point, °C. | 214 | 165 | 193 | 176 | 177 |

EXAMPLE 8

The feedstock used in Examples 9–14 is a straight-run naphtha derived from Seagull Uinta Basin crude oil having the following characteristics:

| | |
|---|---|
| Specific gravity | 0.745 |
| Distillation, ASTM D-86, °C. | |
| IBP | 85 |
| 50% | 135 |
| 90% | 177 |
| EP | 214 |
| Mass % | |
| paraffins | 65 |
| naphthenes | 23 |
| aromatics | 12 |
| Mass % | |
| $C_5$ | 0.2 |
| $C_6$ | 12.1 |
| $C_7+$ | 87.7 |

EXAMPLE 9

Selective isoparaffin synthesis was carried out on the above full-range naphtha using a solid acid selective isoparaffin synthesis catalyst comprising platinum-$AlCl_3$ alumina as disclosed in Example 1. Selective isoparaffin synthesis was effected in a hydrogen atmosphere at a pressure of 30 atmospheres gauge and a liquid hourly space velocity of 2.0 $hr^{-1}$. A platinum-on-alumina aromatics-saturation catalyst amounting to ⅓ of the volume of the selective isoparaffin-synthesis catalyst was loaded into the reactor ahead of the synthesis catalyst. Conversion of $C_7$ + was varied over a range as indicated below by varying temperature from 120° to 180° C.

The table below shows product distributions, conversion of cyclics in the feedstock, naphtha end point reduction and isobutane content of the butane product for $C_7+$ conversion ranging from 28% to 57%:

| | Conversion: | | |
|---|---|---|---|
| | 28% | 49% | 57% |
| Product, mass %: | | | |
| $C_3$ and lighter | 0.3 | 1.4 | 3.1 |
| Butanes | 8.6 | 18.7 | 24.7 |
| Pentanes | 7.2 | 12.8 | 14.6 |
| $C_6$ and heavier | 83.9 | 67.1 | 57.6 |
| Cyclics conv., % | 2.4 | 7.8 | 16.2 |
| $C_5+$ end point, °C.* | 192 | 158 | 139 |
| Isobutane/$C_4$ | .95 | .93 | .90 |

EXAMPLE 10

Selective isoparaffin synthesis was carried out on the above full-range naphtha using a Y-zeolite-based (FAU) catalyst. The extruded catalyst base comprised 80 mass %-zeolite and 20 mass % alumina. Platinum was impregnated on the base in a solution of 0.7% nitric acid to achieve a level of 0.29 mass % Pt on the finished catalyst. The catalyst was oxidized and reduced at 525° C. before being loaded into the reactor.

Selective isoparaffin synthesis was effected in a hydrogen atmosphere at a pressure of 30 atmospheres gauge and a liquid hourly space velocity of 2.0 $hr^{-1}$. Conversion of $C_7+$ was varied over a range of 6% to 94% by varying temperature from 220° to 271° C. The table below shows product distributions, conversion of cyclics in the feedstock, naphtha end point reduction and isobutane content of the butane product for a middle range of $C_7+$ conversions:

| | Conversion: | | |
|---|---|---|---|
| | 28% | 47% | 61% |
| Product, mass %: | | | |
| $C_3$ and lighter | 1.4 | 4.3 | 6.0 |
| Butanes | 8.2 | 10.2 | 20.5 |
| Pentanes | 8.3 | 14.4 | 15.9 |
| $C_6$ and heavier | 82.1 | 71.1 | 57.6 |
| Cyclics conv., % | 8.1 | 14.8 | 31.3 |
| $C_5+$ end point, °C.* | 183 | 157 | 142 |
| Isobutane/$C_4$ | .79 | .88 | .77 |

Figure 2:
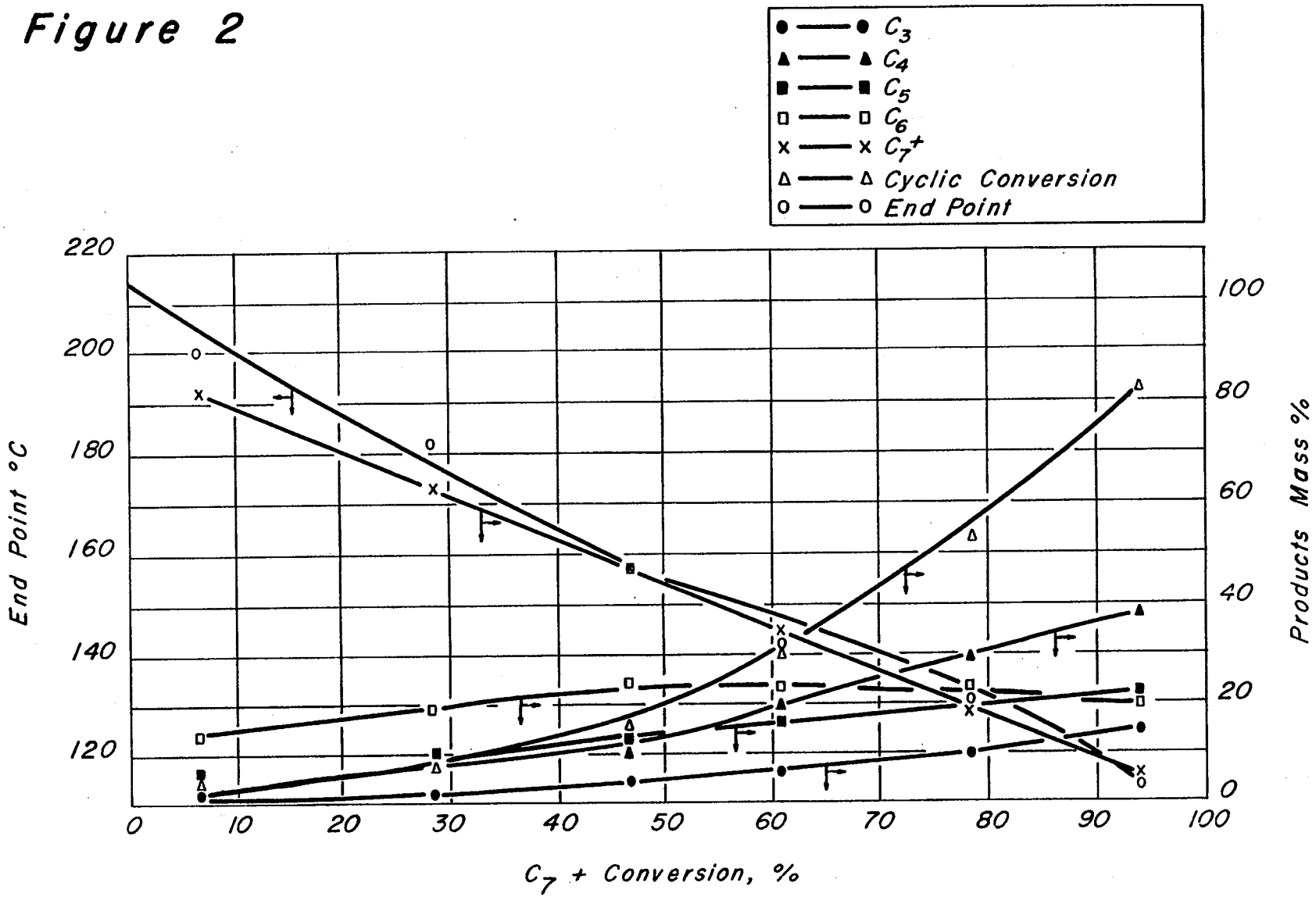
FIG. 2 shows selective isoparaffin synthesis yields and temperature requirements using a FAU zeolite-containing catalyst.

Data from the full range of $C_7+$ conversion are plotted in FIG. 2.

EXAMPLE 11

Selective isoparaffin synthesis was carried out on the above full-range naphtha using a Beta-zeolite-based catalyst. The extruded catalyst base comprised 70 mass % Beta-zeolite and 30 mass % alumina. Platinum was impregnated on the base in a 2% HCl solution to achieve a level of 0.29 mass % Pt on the finished catalyst. The catalyst was oxidized and reduced before being loaded into the reactor behind an aromatics-saturation catalyst.

Selective isoparaffin synthesis was effected in a hydrogen atmosphere at a pressure of 30 atmospheres gauge and a liquid hourly space velocity of 2.0 $hr^{-1}$. Conversion of $C_7+$ was varied over a range of about 28% to 94% by varying temperature from 245° to 280° C. The table below shows product distributions, conversion of cyclics in the feedstock, naphtha end point reduction and isobutane content of the butane product for a middle range of $C_7+$ conversions:

| | Conversion: | | |
|---|---|---|---|
| | 28% | 49% | 70% |
| Product, mass %: | | | |
| $C_3$ and lighter | 1.7 | 3.7 | 7.9 |
| Butanes | 8.3 | 17.2 | 26.8 |
| Pentanes | 7.6 | 13.0 | 16.7 |
| $C_6$ and heavier | 82.4 | 66.1 | 48.6 |
| Cyclics conv., % | 6.5 | 17.0 | 38.3 |
| $C_{5k}+$ end point, °C.* | 172 | 158 | 152 |
| Isobutane/$C_4$ | .72 | .79 | .77 |

Figure 3:
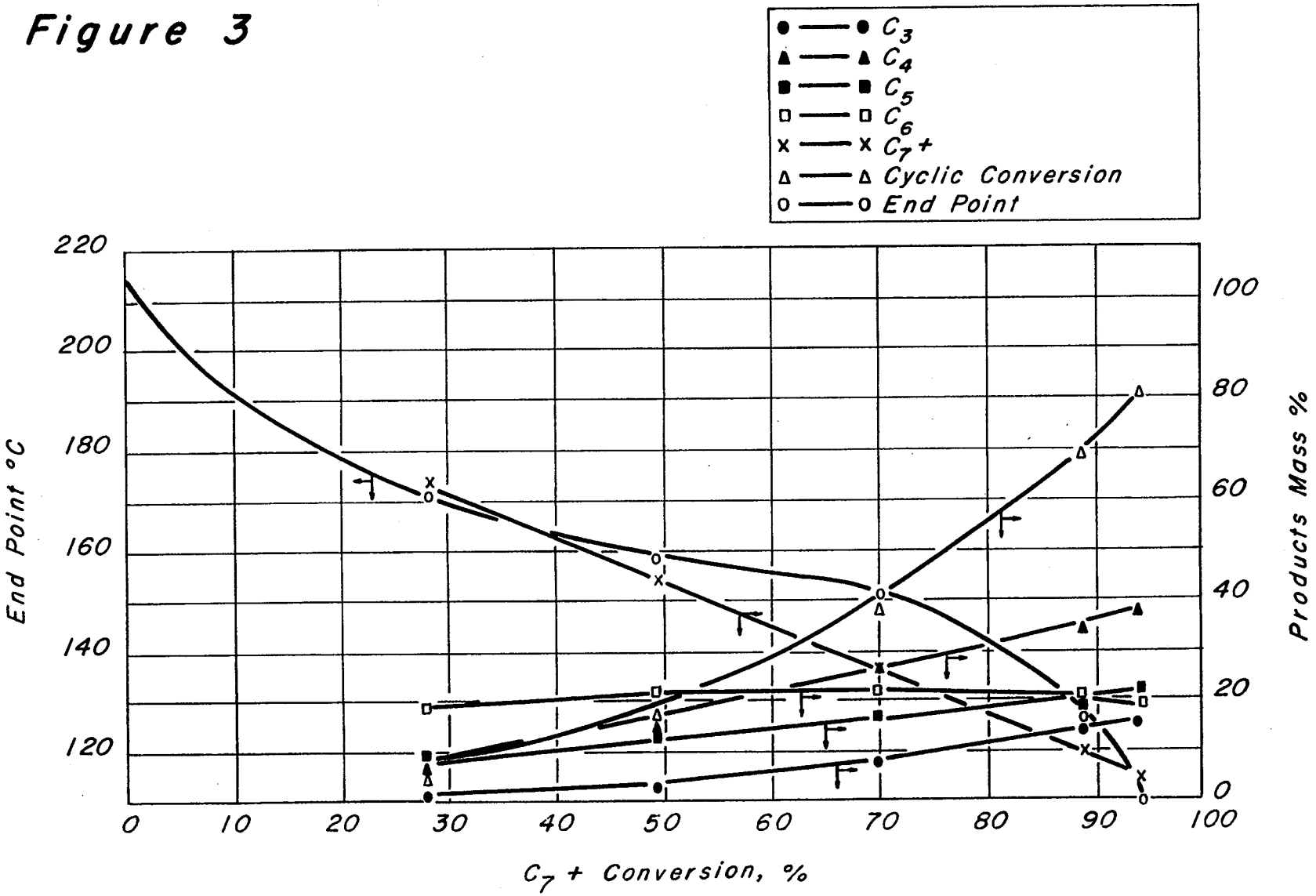
FIG. 3 shows selective isoparaffin synthesis yields and temperature requirements using a Beta-zeolite-containing catalyst.

Data from the full range of $C_7+$ conversions are plotted in FIG. 3.

EXAMPLE 12

Selective isoparaffin synthesis was carried out on the above full-range naphtha using an oil-dropped spherical catalyst comprising sulphuric acid impregnated on a zirconia base. Platinum was impregnated to achieve a level of 0.92 mass % Pt on the finished catalyst. The catalyst was oxidized and reduced before being loaded into the reactor behind an aromatics-saturation catalyst.

Selective isoparaffin synthesis was effected in a hydrogen atmosphere at a pressure of 30 atmospheres gauge and a liquid hourly space velocity of 2.0 $hr^{-1}$. Conversion of $C_7+$ was varied over a range of about 46% to 83% by varying temperature from 177° to 220° C. The table below shows product distributions, conversion of cyclics in the feedstock, naphtha end point reduction and isobutane content of the butane product for a middle range of $C_7+$ conversions:

| | Conversion: | | |
|---|---|---|---|
| | 46% | 65% | 73% |
| Product, mass %: | | | |
| $C_3$ and lighter | 3.1 | 6.9 | 8.8 |
| Butanes | 15.5 | 24.4 | 28.4 |
| Pentanes | 11.9 | 15.3 | 16.7 |
| $C_6$ and heavier | 69.5 | 59.8 | 46.1 |
| Cyclics conv., % | 6.2 | 22.4 | 33.2 |
| $C_5+$ end point, °C.* | 171 | 158 | 158 |
| Isobutane/$C_4$ | .85 | .84 | .81 |

Figure 4:
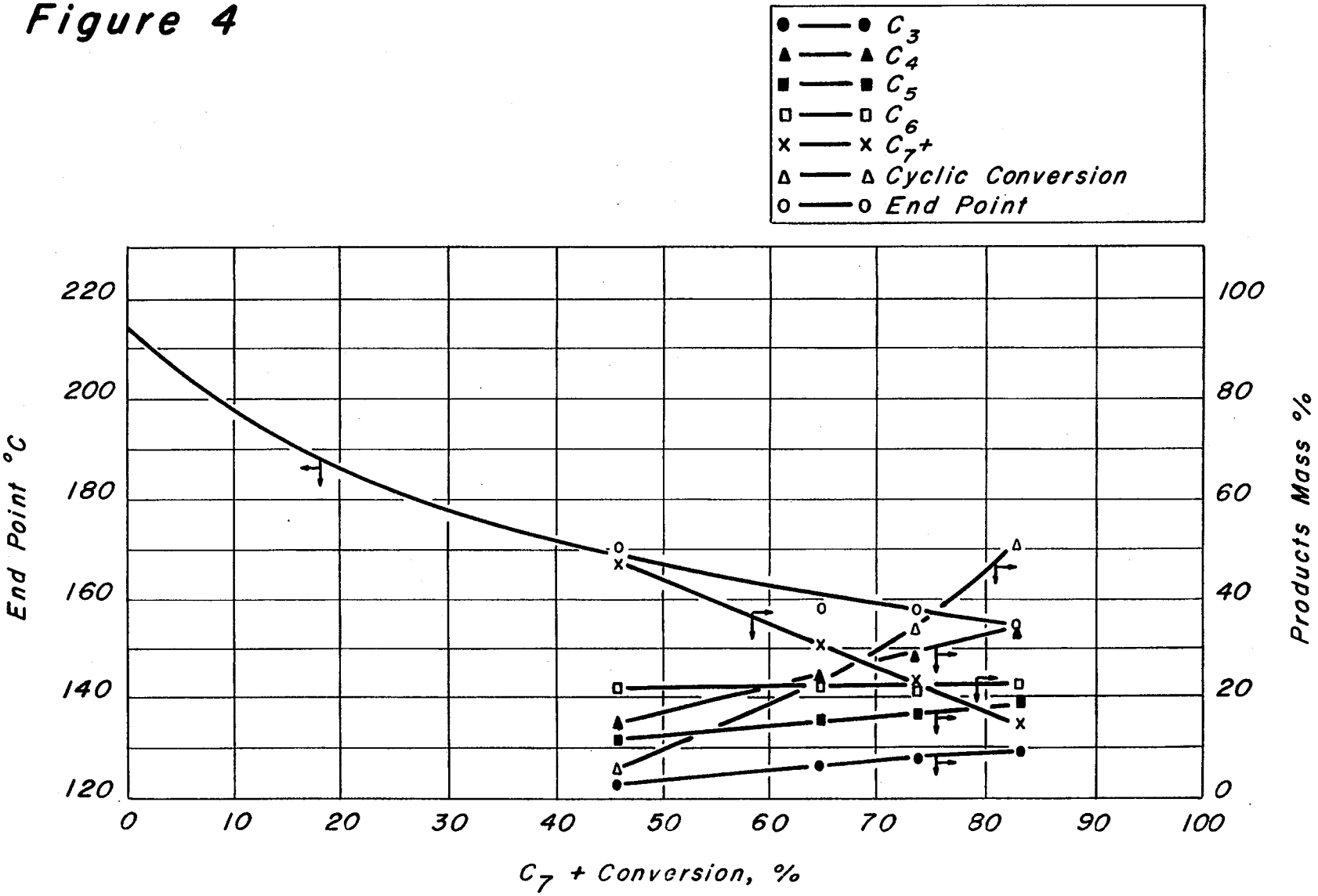
FIG. 4 shows selective isoparaffin synthesis yields and temperature requirements using a catalyst comprising sulfate incorporated into a zirconia support.

Data from the full range of $C_7+$ conversions are plotted in FIG. 4.

EXAMPLE 13

Selective isoparaffin synthesis was carried out on full-boiling range Seagull Uinta Basin naphtha using a mordenite-based (MOR) catalyst. The naphtha feedstock was as shown in Example 8 after removal of a small amount of heavy tail material by fractional distillation. The end point of the naphtha was reduced to 193° C. with minor effects on other naphtha properties.

The extruded catalyst base comprised 50 mass % mordenite and 50 mass % alumina. Platinum was impregnated on the base, using a solution of chloroplatinic acid and hydrochloric acid in deionized water, to achieve a level of 0.4 mass % Pt on the finished catalyst. The catalyst was oxidized, reduced and sulfided before being loaded into the reactor.

Selective isoparaffin synthesis was effected in a hydrogen atmosphere at a pressure of 68 atmospheres gauge and a liquid hourly space velocity of 2.0 $hr^{-1}$. Conversion of $C_7$ was varied over a range of less than 30% to nearly 90% by varying temperature from 282° to 316° C. The table below shows product distributions and isobutane content of the butane product:

| | Temperature, °C.: | | | |
|---|---|---|---|---|
| | 282 | 293 | 304 | 316 |
| Product, mass %: | | | | |
| $C_3$ and lighter | 2.3 | 4.5 | 13.1 | 19.9 |
| Butanes | 8.8 | 14.7 | 17.6 | 38.2 |
| Pentanes | 9.5 | 13.8 | 19.8 | 17.7 |
| $C_6$ and heavier | 79.8 | 67.6 | 50.5 | 25.6 |
| Isobutane/$C_4$ | .74 | .73 | .53 | .74 |

EXAMPLE 14

The feedstock used to develop Examples 15–17 is a hydrotreated mixture of straight-run, hydrocracked and coker naphtha form blended crude oils. The naphtha previously had been distilled to separate a light naphtha fraction, and was separated by distillation to yield heart-cut and heavy naphtha fractions as indicated:

| | Naphtha 82–175° C. | Heart Cut 82–130° C. | Heavy 130–175° C. |
|---|---|---|---|
| Proportion, vol. % | 100 | 60 | 40 |
| Specific gravity | 0.753 | 0.738 | 0.787 |
| Distillation, ASTM D-86, °C. | | | |
| IBP | 82 | 82 | 129 |
| 50% | 113 | 99 | 143 |
| 90% | 146 | 111 | 162 |
| EP | 177 | 130 | 177 |
| Mass % | | | |
| paraffins | 38.2 | 42.5 | 31.6 |
| naphthenes | 50.6 | 48.5 | 53.7 |
| aromatics | 11.2 | 9.0 | 14.7 |
| Mass % | | | |
| $C_6$ | 16.2 | 27 | — |
| $C_7$ | 35.2 | 53 | 8.6 |
| $C_8$ | 23.4 | 20 | 28.8 |
| $C_9$ | 17.9 | — | 44.4 |
| $C_{10}+$ | 7.3 | — | 18.2 |

EXAMPLE 15

This Example presents a reforming process of the prior art, producing a gasoline component which has an unacceptable endpoint for current U.S. reformulated gasoline blends. The feedstock to the reforming process is the "naphtha" as described in Example 14. The reforming operation is carried out using a conventional spherical platinum-rhenium-on-alumina catalyst at a pressure of about 27 atmospheres gauge and a severity of 95 Research octane number (RON) clear on the $C_5+$ product.

The quantity of feedstock is 3250 $m^3$/day. Yields of hydrogen and $C_5+$ reformate and high-end distillation characteristics of the reformate are as follows:

| | |
|---|---|
| Net $H_2$ production, $10^3Nm^3$/day | 573 |
| Yields, $m^3$/day: | |
| $C_5$+ component | 2685 |
| $C_5$+ ASTM D-86: | |
| 90% point, °C. | 150 |
| End point, °C. | 196 |

EXAMPLE 16

This Example is an illustration of the process combination of the invention for comparison with prior-art Example 15. The naphtha described hereinabove is fractionated to separate a 130° C. and heavier cut from a cut boiling up to about 130° C. in accordance with the Figure and as characterized in Example 14. The heavy naphtha is processed by selective isoparaffin synthesis followed by fractionation of the effluent to yield isobutane concentrate and a $C_5$+ synthesis product. Yields in the selective-isoparaffin-synthesis zone are based on the use of a platinum-mordenite catalyst as described hereinabove containing about 0.25 mass % platinum. Product yields from fractionation of 3250 $m^3$/day of naphtha and synthesis are as follows:

| | |
|---|---|
| IBP - 130°C. naphtha to reforming, $m^3$/day | 1950 |
| 130° C. and heavier naphtha to synthesis, $m^3$/day | 1300 |
| Hydrogen production, $10^3Nm^3$/day | 66 |
| Yields, $M^3$/day: | |
| Iso$C_4$ concentrate | 263 |
| $C_5$+ synthesis product | 993 |

The isobutane concentrate comprises about 69% isobutane.

The IBP-130° C. naphtha is processed in a reforming unit using a conventional spherical platinum-rhenium-on-alumina catalyst as in Example 3 at an operating pressure of about 20 atmospheres gauge and a severity of 95 Research octane number (RON) clear on the $C_5$+product. After stabilization of the reformate to remove the small amount of $C_4$ and lighter produced, the $C_5$+ is blended with $C_5$+$C_6$ from selective isoparaffin synthesis to obtain a gasoline component. Overall yields of the selective-isoparaffin-synthesis/reforming combination, considering hydrogen production in the reformer as well as consumption in the selective isoparaffin synthesis, are as follows from 3250 cubic meters/day of naphtha:

| | |
|---|---|
| Net $H_2$ production, $10^3Nm^3$/day | 340 |
| Yields, $m^3$/day: | |
| Iso$C_4$ concentrate | 424 |
| $C_5$+ component | 2475 |
| $C_5$+ ASTM D-86: | |
| 90% point, °C. | 135 |
| Endpoint, °C. | 159 |

EXAMPLE 17

A comparison of the cases of Examples 15 and 16 shows the impact on yields of using the present invention to reduce the end point of a gasoline component, based on 3250 cubic meters per day of naphtha feed:

| | Example | |
|---|---|---|
| | 15 | 16 |
| Invention? | No | Yes |
| Synthesis feed, $m^3$/day | — | 1300 |
| Net $H_2$, $10^3Nm^3$/day | 386 | 340 |
| Iso$C_4$ + $C_5$+, $m^3$/day | 2766 | 2899 |
| $C_5$+, $m^3$/day | 2766 | 2475 |
| 90% point, °C. | 173 | 135 |
| End point, °C. | 214 | 159 |

The invention enables end-point reduction with very little difference in $C_4$+ yield. The net hydrogen production is reduced with the addition of selective isoparaffin synthesis, but a favorable balance may be maintained in the reforming/selective-isoparaffin-synthesis combination.

We claim as our invention:

1. A process combination for selectively upgrading a naphtha feedstock to obtain gasoline of enhanced octane number comprising the steps of:

(a) separating a naphtha feedstock to obtain a heart-cut naphtha fraction comprising $C_7$ and $C_8$ hydrocarbons and a heavy naphtha fraction comprising $C_{10}$ hydrocarbons;

(b) contacting the heart-cut naphtha fraction with a reforming catalyst, comprising a supported platinum-group metal component, in a catalytic-reforming zone maintained at reforming conditions comprising a pressure of from about atmospheric to 20 atmospheres absolute, a molar hydrogen-to-hydrocarbon ratio of from about 0.1 to 10, a liquid hourly space velocity of from about 1 to 40 $hr^{-1}$, and a temperature of from 260° to 560° C. and recovering a stabilized reformate; and, (c) contacting the heavy naphtha fraction with a solid acid selective isoparaffin-synthesis catalyst comprising a zeolite in a selective-isoparaffin-synthesis zone maintained at selective-isoparaffin-synthesis conditions comprising a pressure of from about 10 atmospheres to 100 atmospheres gauge, a molar hydrogen-to-hydrocarbon ratio of from about 0.1 to 10, a liquid hourly space velocity of between about 0.5 to 20 $hr^{-1}$, and a temperature of from 50° to 350° C. and recovering synthesis effluent having a reduced end point relative to the heavy naphtha fraction and containing butanes and pentanes.

2. The process combination of claim 1 wherein step (a) further comprises separating a light naphtha fraction comprising pentanes from the naphtha feedstock.

3. The process combination of claim 2 wherein the light naphtha fraction comprises $C_6$ hydrocarbons.

4. The process combination of claim 2 further comprising contacting at least a portion of the light naphtha fraction in a naphtha isomerization zone at isomerization conditions using an acidic isomerization catalyst to obtain an isomerized product.

5. The process combination of claim 4 wherein the isomerized product is separated into:

(a) a lower-octane recycle to the isomerization zone, to obtain additional isomerized product; and, (b) an iso-rich product.

6. The process combination of claim 1 wherein the reforming-catalyst support comprises a refractory inorganic oxide.

7. The process combination of claim 6 wherein the refractory inorganic oxide comprises one or more of silica and alumina.

8. The process combination of claim 1 wherein the platinum-group metal component comprises a platinum component.

9. The process combination of claim 6 wherein the reforming catalyst comprises a large-pore molecular sieve.

10. The process combination of claim 9 wherein the large-pore molecular sieve comprises nonacidic L-zeolite.

11. The process combination of claim 10 wherein the nonacidic L-zeolite comprises potassium-form L-zeolite.

12. The process combination of claim 1 wherein the synthesis effluent of step (c) is separated to obtain a light synthesis naphtha comprising pentanes and a heavy synthesis naphtha comprising $C_7$ and $C_8$ hydrocarbons which is contacted with a catalyst, comprising a supported platinum-group metal component, in a reforming zone to obtain a reformed synthesis product.

13. The process combination of claim 12 wherein the reforming zone is the catalytic-reforming zone of step (b) and the reformed synthesis product is an integral part of the stabilized reformate.

14. The process combination of claim 1 wherein the butanes of step (c) amount to at least 8.0 volume % of the heavy naphtha fraction.

15. The process combination of claim 1 wherein the butanes of step (c) comprise isobutane in a ratio to normal butane substantially above the thermodynamic-equilibrium ratio at the selective-isoparaffin-synthesis conditions.

16. The process combination of claim 1 further comprising recovering an isobutane-rich stream from the selective-isoparaffin-synthesis zone of step (c).

17. The process combination of claim 1 wherein the selective isoparaffin-synthesis catalyst comprises a platinum-group metal component on an inorganic-oxide support.

18. The process combination of claim 17 wherein the inorganic-oxide support comprises alumina.

19. The process combination of claim 1 wherein the zeolite comprises mordenite.

20. The process combination of claim 1 wherein the naphtha feedstock comprises a catalytically cracked gasoline feedstock.

21. The process combination of claim 1 wherein the reforming of step (b) and the selective isoparaffin synthesis of step (c) are heat-integrated to reduce external heating and cooling requirements.

22. A process combination for selectively upgrading a naphtha feedstock to obtain gasoline of enhanced octane number comprising the steps of:

(a) separating a naphtha feedstock to obtain a light naphtha fraction comprising pentanes, a heart-cut naphtha fraction comprising $C_7$ and $C_8$ hydrocarbons and a heavy naphtha fraction comprising $C_{10}$ hydrocarbons;

(b) contacting the heart-cut naphtha fraction and a heavy synthesis naphtha with a reforming catalyst, comprising a supported platinum-group metal component and a nonacidic L-zeolite, in a catalytic-reforming zone maintained at reforming conditions comprising a pressure of from about atmospheric to 20 atmospheres absolute, a molar hydrogen-to-hydrocarbon ratio of from about 0.1 to 10, a liquid hourly space velocity of from about 1 to 40 $hr^{-1}$, and a temperature of from 260° to 560° C. and recovering a stabilized reformate; and, (c) contacting the heavy naphtha fraction with a solid acid selective isoparaffin-synthesis catalyst comprising a zeolite in an selective-isoparaffin-synthesis zone maintained at selective-isoparaffin-synthesis conditions comprising a pressure of from about 10 atmospheres to 100 atmospheres gauge, a molar hydrogen-to-hydrocarbon ratio of from about 0.1 to 10, a liquid hourly space velocity of between about 0.5 to 20 $hr^{-1}$, and a temperature of from 50° to 450° C. in the presence of hydrogen, recovering synthesis effluent containing butanes and pentanes, and separating the synthesis effluent to obtain an isobutane concentrate, a light synthesis naphtha comprising pentanes and heavy synthesis naphtha comprising $C_7$ and $C_8$ hydrocarbons.

23. A process combination for selectively upgrading a naphtha feedstock to obtain gasoline of enhanced octane number comprising the steps of:

(a) separating a naphtha feedstock to obtain a light naphtha fraction comprising pentanes, a heart-cut naphtha fraction comprising $C_7$ and $C_8$ hydrocarbons and a heavy naphtha fraction comprising $C_{10}$ hydrocarbons;

(b) contacting the heart-cut naphtha and a heavy synthesis naphtha with a reforming catalyst, comprising a supported platinum-group metal component and a nonacidic L-zeolite, in a catalytic-reforming zone maintained at reforming conditions comprising a pressure of from about atmospheric to 20 atmospheres absolute, a molar hydrogen-to-hydrocarbon ratio of from about 0.1 to 10, a liquid hourly space velocity of from about 1 to 40 $hr^{-1}$, and a temperature of from 260° to 560° C. and recovering a stabilized reformate; and, (c) contacting the heavy naphtha fraction with a solid acid selective isoparaffin-synthesis catalyst in an selective-isoparaffin-synthesis zone maintained at selective-isoparaffin-synthesis conditions comprising a pressure of from about 10 atmospheres to 100 atmospheres gauge, a molar hydrogen-to-hydrocarbon ratio of from about 0.1 to 10, a liquid hourly space velocity of between about 0.5 to 20 $hr^{-1}$, and a temperature of from 50° to 450° C. in the presence of hydrogen, recovering synthesis effluent containing butanes and pentanes, and separating the synthesis effluent to obtain an isobutane concentrate, a light synthesis naphtha comprising pentanes and heavy synthesis effluent comprising $C_7$ and $C_8$ hydrocarbons;

(d) contacting the heavy synthesis effluent with a reforming catalyst, comprising a supported platinum-group metal component and a nonacidic L-zeolite, in a catalytic-reforming zone maintained at reforming conditions comprising a pressure of from about atmospheric to 20 atmospheres absolute, a molar hydrogen-to-hydrocarbon ratio of from about 0.1 to 10, a liquid hourly space velocity of from about 1 to 40 $hr^{-1}$, and a temperature of from 260° to 560° C. and recovering a reformed synthesis product as a stabilized reformate; and (e) blending the gasoline comprising at least a portion of each of the light naphtha, light synthesis naphtha and stabilized reformate.

* * * * *